US008201333B2

(12) United States Patent
Wysock et al.

(10) Patent No.: US 8,201,333 B2
(45) Date of Patent: Jun. 19, 2012

(54) METHOD OF MAKING FLUSH DOOR SKINS

(75) Inventors: Gregory J. Wysock, Sycamore, IL (US); Steven K. Lynch, St. Charles, IL (US); Robert C. Allen, Elburn, IL (US)

(73) Assignee: Masonite Corporation, Tampa, FL (US)

( * ) Notice: Subject to any disclaimer, the term of this patent is extended or adjusted under 35 U.S.C. 154(b) by 251 days.

(21) Appl. No.: 12/392,815

(22) Filed: Feb. 25, 2009

(65) Prior Publication Data

US 2010/0212258 A1 Aug. 26, 2010

(51) Int. Cl.
*B21D 47/00* (2006.01)

(52) U.S. Cl. ..... 29/897.32; 29/897.3; 29/401.1; 29/417; 52/745.16; 52/784.1; 83/862; 144/368; 216/29; 216/100

(58) Field of Classification Search ..... 29/897.32, 29/897.3, 401.1, 416, 417; 52/456, 473, 52/784.1, 745.16; 83/862, 863; 144/3.1, 144/136.95, 137, 367, 368; 216/32, 29, 41, 216/48, 100
See application file for complete search history.

(56) References Cited

U.S. PATENT DOCUMENTS

| | | | | |
|---|---|---|---|---|
| 1,867,575 | A | 7/1932 | Loetscher | |
| 4,550,540 | A | 11/1985 | Thorn | |
| 4,853,062 | A | 8/1989 | Gartland | |
| 5,344,484 | A | 9/1994 | Walsh | |
| 5,979,525 | A * | 11/1999 | Durney | 144/368 |
| 6,079,183 | A | 6/2000 | Moyes | |
| 6,309,503 | B1 | 10/2001 | Martino | |
| 6,312,540 | B1 | 11/2001 | Moyes | |
| 6,335,082 | B1 | 1/2002 | Martino | |
| 6,389,768 | B1 | 5/2002 | Gagne et al. | |
| 6,471,897 | B1 | 10/2002 | Walsh et al. | |
| 6,868,644 | B2 | 3/2005 | Frankefort et al. | |
| 7,337,543 | B2 | 3/2008 | Liittschwager et al. | |
| 7,338,612 | B2 | 3/2008 | Luetgert et al. | |
| 7,367,166 | B2 | 5/2008 | Luetgert et al. | |
| 7,919,148 | B2 * | 4/2011 | Chen et al. | 427/407.1 |
| 7,959,817 | B2 * | 6/2011 | Luetgert et al. | 216/32 |
| 2005/0194106 | A1 | 9/2005 | Scales | |
| 2007/0028559 | A1 | 2/2007 | Lynch et al. | |
| 2007/0193173 | A1 * | 8/2007 | Coughlin et al. | 52/473 |
| 2008/0041014 | A1 | 2/2008 | Lynch et al. | |

FOREIGN PATENT DOCUMENTS

| | | |
|---|---|---|
| EP | 1 442 858 | 8/2004 |

* cited by examiner

*Primary Examiner* — Richard Chang
(74) *Attorney, Agent, or Firm* — Berenato & White, LLC

(57) ABSTRACT

Universal master boards and methods of making flush door skins and doors from the universal master boards are disclosed. The universal master boards each have an expansive surface with a graphic design of at least first depressions and second depressions in at least first and second surface regions, respectively. The first depressions simulate a first wood grain pattern, and the second depressions simulate a second wood grain pattern aligned in a different direction than the simulated first wood grain pattern. The universal master boards may be cut and demarcated selectively to establish different assortments of simulated wood patterns and different ornamental features, such as stiles and rails.

27 Claims, 16 Drawing Sheets

METHOD OF MAKING FLUSH DOOR SKINS

FIELD OF THE INVENTION

The invention, in certain embodiments, relates to methods of making flush door skins and assembled doors from universal master boards, to methods of creating ornamental surface designs on flush doors skins, and to the universal master boards, flush door skins, and assembled doors.

BACKGROUND

There are several known techniques for manufacturing composite, hollow-core doors with ornamental features such as simulated panels and simulated wood grains. Standard wood composite door skins are formed from a relatively thick non-solid mat or bat of material, which is compressed in a press to a reduced thickness door skin. The door skin may optionally then be post-formed in a reforming process, and subsequently finished using primers, pigments, and the like. Respective finished door skins then are secured to opposing sides of a support frame to define a hollow-core door.

A flush door skin is substantially flat or planar, especially along its interior surface which is secured to the support frame. Because flush door skins do not require three-dimensional reshaping in contoured mold cavities, flush door skins are less expensive to manufacture than three-dimensional molded door skins having contoured interior and exterior surfaces. Although flush door skins are principally flat, the exterior surface of a flush door skin may be embossed or otherwise cut or machined to create depressions that give the exterior door skin surface an ornamental appearance. The depressions may, for example, be formed as grooves extending over a significant portion of the door skin to define the boundaries of simulated stiles, rails and other planks and interior panels. It is also known to form patterns of smaller discrete depressions in the exterior surfaces of flush door skins to simulate natural wood grain textures. Such depressions are typically embossed into the exterior surface during compression of the mat or bat into the door blank, or in a subsequent reformation step against a mold die or embossing plate.

One problem that arises in the manufacture of flush door skins is that the uniform ornamental design produced by certain die mold equipment might not appease the distinguishing yet variable tastes and preferences of consumers. One consumer may prefer flush door skins with a single simulated interior panel, while another consumer may desire multiple simulated internal panels, for example. Other ornamental design options that consumers may differ on include the number, shape, site and location of stiles, rails, and other planks and the directional flow of wood grain patterns. The potential number of design options and combinations of ornamental features are many. However, conventional production of each different door design requires its own die sets for pressing the desired ornamental features into the surface of the door skin. In addition, a separate die set may be required for different length door skins, even if the panel design is similar, given the panel dimensions may proportionally change with the overall size of the door. The use of multiple die sets presents considerable storage, costs, operational problems.

One option for addressing these problems is to implement printing technologies such as ink-jet printing to apply graphics simulating wood grain and panels to the exterior surfaces of door skins in a post-pressing step. However, ink decorations alone are not always realistic and aesthetically acceptable to discriminate consumers. Ink decorations alone also lack the textural feel simulation of an authentic object such as natural wood.

Veneering is another post-pressing step for creating ornamental designs such as stiles, rails, and wood graining on the exterior surface of a door skin. Veneering, however, has its own drawbacks, such as lack of realistic texture, the extensive production times required for proper alignment and laying of the veneers, and high cost. Further, veneers can conceal smaller discrete embossments simulating wood grain texture in the exterior surface of the door skin.

Certain conveniences and manufacturing efficiencies could be realized if ornamental features such as stiles, rails, interior panels, and grain direction could be formed in or selected for flush door skins after the skins or precursor boards are pressed in a mold die. The downstream transition of decorating and design selection steps in the manufacturing process would permit the stocking of large numbers of universal or generic flush door skins or door skin precursor boards in inventory while improving production rates. The ornamental designs of the universal/generic flush door skins and/or precursor boards could then be individually tailored to specific customer orders in a post-pressing step or steps.

SUMMARY OF THE INVENTION

A first aspect of the invention provides a method of converting universal master boards into flush door skins having different assortments of simulated wood grain patterns. A plurality of universal master boards each having an expansive surface is provided. Each expansive surface has a graphic design of at least first depressions and second depressions in at least first and second surface regions, respectively. The first depressions are substantially parallel to one another and substantially aligned in a first direction to simulate a first wood grain pattern in the first surface region. The second depressions are substantially parallel to one another and substantially aligned in a second direction that is different than the first direction to simulate a second wood grain pattern in the second surface region. The first universal master board is cut to form a first flush door skin having a first exterior surface with a first assortment of simulated wood grains including at least one pattern selected from the simulated first wood grain pattern and the simulated second wood grain pattern. The second universal master board is also cut to form a second flush door skin having a second exterior surface with a second assortment of simulated wood grains including at least one pattern selected from the simulated first wood grain pattern and the simulated second wood grain pattern. The second assortment of simulated wood grains differs from the first assortment of simulated wood grains.

A second aspect of the invention relates to a method of converting universal master boards into flush door skins having different assortments of simulated wood grain patterns. Universal master boards are provided, each board having an expansive surface. Each expansive surface has a graphic design of at least first depressions and second depressions in at least first and second surface regions, respectively. The first depressions are substantially parallel to one another and substantially aligned in a first direction to simulate a first wood grain pattern in the first surface region, the second depressions are substantially parallel to one another and substantially aligned in a second direction that is different than the first direction to simulate a second wood grain pattern in the second surface region. A first universal master board is cut to form a first flush door skin having a first exterior surface with a selected first assortment of simulated wood grains including at least one pattern selected from the simulated first wood grain pattern and the simulated second wood grain pattern. The first assortment of simulated wood grains is demarcated into a plurality of sections representing first ornamental features to establish a first ornamental surface design for the first flush door skin. A second universal master board is cut to form a second flush door skin having a second exterior surface with a selected second assortment of simulated wood grains including at least one pattern selected from the simulated first wood grain pattern and the simulated second wood grain pattern, the second assortment differing from the first assortment. The second assortment of simulated wood grains is demarcated into a plurality of sections representing second ornamental features to establish a second ornamental surface design for the second flush door skin.

A third aspect of the invention relates to a method of converting universal master boards into flush door skins having different assortments of simulated wood grain patterns. A plurality of flush universal master boards each having an expansive surface is provided. Each expansive surface has a graphic design of depressions that are substantially parallel to one another and substantially aligned in a direction to simulate a wood grain pattern. The expansive surface of a first flush universal master board is demarcated into a plurality of sections representing first ornamental features to establish a first ornamental surface design. The expansive surface of a second flush universal master board is demarcated into a plurality of sections representing second ornamental features to establish a second ornamental surface design differing from the first ornamental surface design.

According to a fourth aspect of the invention, a method is provided of making a flush door skin from a universal master board having a surface with a graphic design of first depressions and second depressions in the surface at first and second surface regions, respectively. The first depressions are substantially parallel to one another and substantially aligned in a first direction to simulate a first wood grain pattern in the first surface region. The second depressions are substantially parallel to one another and substantially aligned in a second direction that is different than the first direction to simulate a second wood grain pattern in the second surface region. The surface of the universal master board is sufficiently expansive to permit selective positioning of a hypothetical cutting template having a boundary commensurate with a perimeter of a flush door skin at any one of multiple positions on the surface of the universal master board. At each of the multiple positions, the boundary of the hypothetical cutting template captures a respective one of multiple possible assortments of simulated wood grains. Each of the assortments includes at least one pattern selected from the simulated first wood grain pattern and the simulated second wood grain pattern. The expansive surface of the universal master board is cut along the hypothetical cutting template at the selective position to provide the flush door skin having the selected assortment of simulated wood grains.

According to a fifth aspect of the invention, a universal master board is provided. The universal master board has an expansive surface with a graphic design containing at least first depressions and second depressions in at least first and second surface regions, respectively. The first depressions are substantially parallel to one another and substantially aligned in a first direction to simulate a first wood grain pattern in the first surface region. The second depressions are substantially parallel to one another and substantially aligned in a second direction that is different than the first direction to simulate a second wood grain pattern in the second surface region. The surface of the universal master board is sufficiently expansive to permit selective positioning of a hypothetical cutting template having a boundary commensurate with a perimeter of a flush door skin at any one of multiple possible positions on the surface of the universal master board. At each of the multiple positions the boundary of the hypothetical cutting template captures a respective one of multiple possible assortments of simulated wood grains. Each of the possible assortments comprises at least one pattern selected from the simulated first wood grain pattern and the simulated second wood grain pattern.

Other aspects of the invention, including articles such as pre-assembled doors, kits for assembling a door, methods of assuming doors, apparatus, systems, other methods, and the like which constitute part of the invention, will become more apparent upon reading the following detailed description of the exemplary embodiments and viewing the drawings.

BRIEF DESCRIPTION OF THE DRAWING(S)

The accompanying drawings are incorporated in and constitute a part of the specification. The drawings, together with the general description given above and the detailed description of the exemplary embodiments and methods given below, serve to explain the principles of the invention. In such drawings:

FIG. 1 is an elevational view of a universal master board according to an embodiment of the invention;

FIGS. 1A, 1B, 1C, and 1D are elevational view of universal master boards according to additional embodiments of the invention;

DETAILED DESCRIPTION OF EXEMPLARY EMBODIMENTS AND EXEMPLARY METHODS

Figure 1:
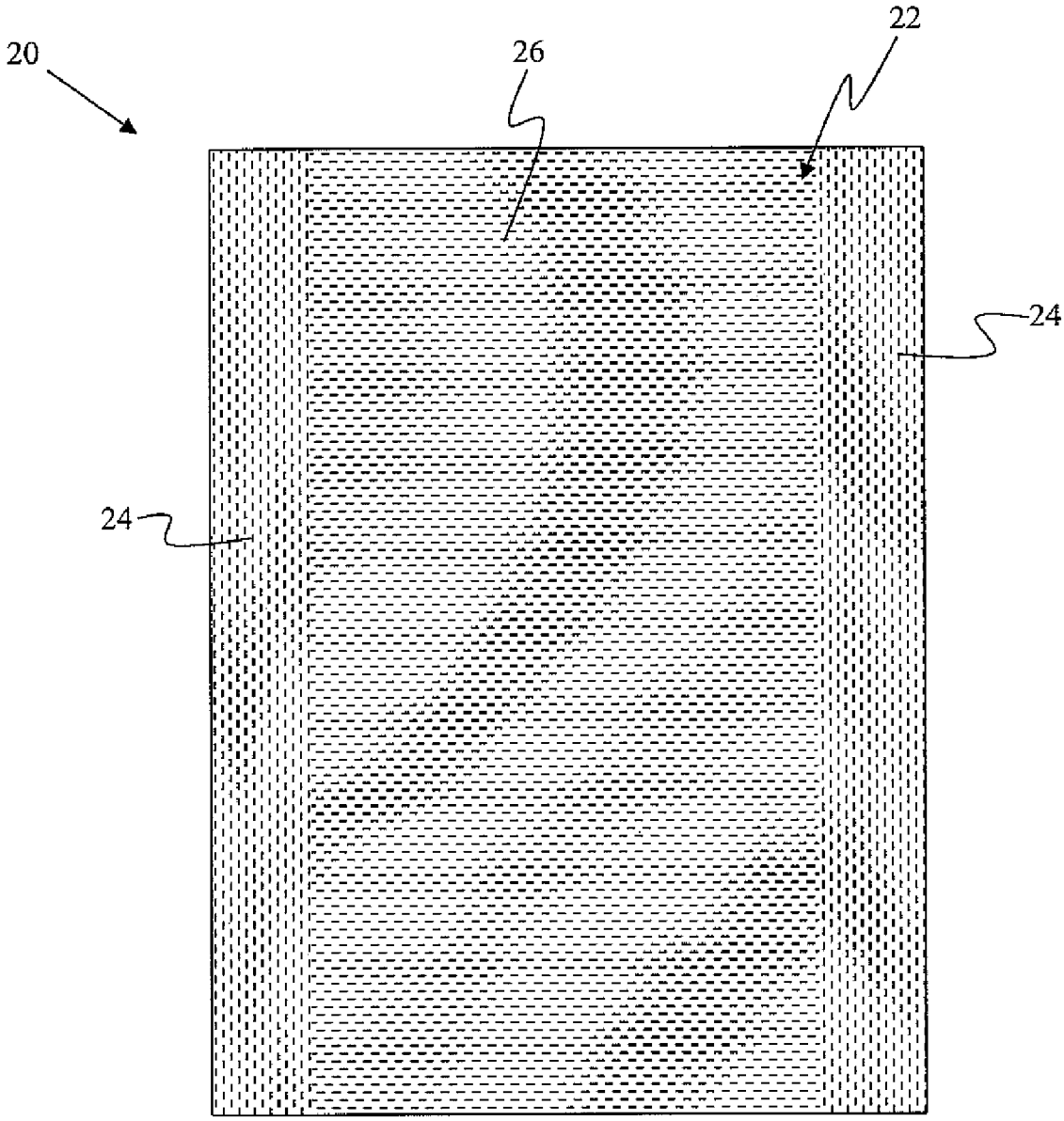

Reference will now be made in detail to exemplary embodiments and exemplary methods of the invention as illustrated in the accompanying drawings, in which like reference characters designate like or corresponding parts throughout the drawings. It should be noted that the invention in its broader aspects is not necessarily limited to the specific details, representative devices and methods, and illustrative examples shown and described in connection with the exemplary embodiments and exemplary methods.

Referring now more particularly to the drawings, in a universal master board according to an exemplary embodiment of the invention is generally depicted in FIG. 1 by reference numeral 20.

The universal master board 20 has an expansive surface 22 shown in plan in FIG. 1. The expansive surface 22 is covered with a graphic design characterized by first depressions and second depressions in first and second surface regions, respectively. The first depressions are substantially parallel to one another and substantially aligned in a first direction to simulate first wood grain patterns 24 in the first surface regions at the opposite lateral sides of the expansive surface 22. The second depressions are substantially parallel to one another and substantially aligned in a second direction that is different than the first direction to simulate a second wood grain pattern 26 in the second surface region at the center of the expansive surface 22. The first and second wood grain patterns 22, 24 may be repeating or non-repeating patterns.

In the exemplary embodiment depicted in FIG. 1, each of the first wood grain patterns 24 is represented as a vertical natural wood grain pattern on the opposite lateral surface regions of the expansive surface 22 and coextensive with the length of the expansive surface 22. The second wood grain pattern 26 is depicted as a horizontal natural wood grain pattern situated between the opposite lateral surface regions of the first wood grain pattern 24 and coextensive with the length of the expansive surface 22. In the illustrated embodiment, the first and second wood grain patterns 24 collectively encompass the entire expansive surface 22 of the universal master board 20. In FIG. 1, the first and second wood grain patterns 22, 24 do not overlap one another.

Figure 1A:
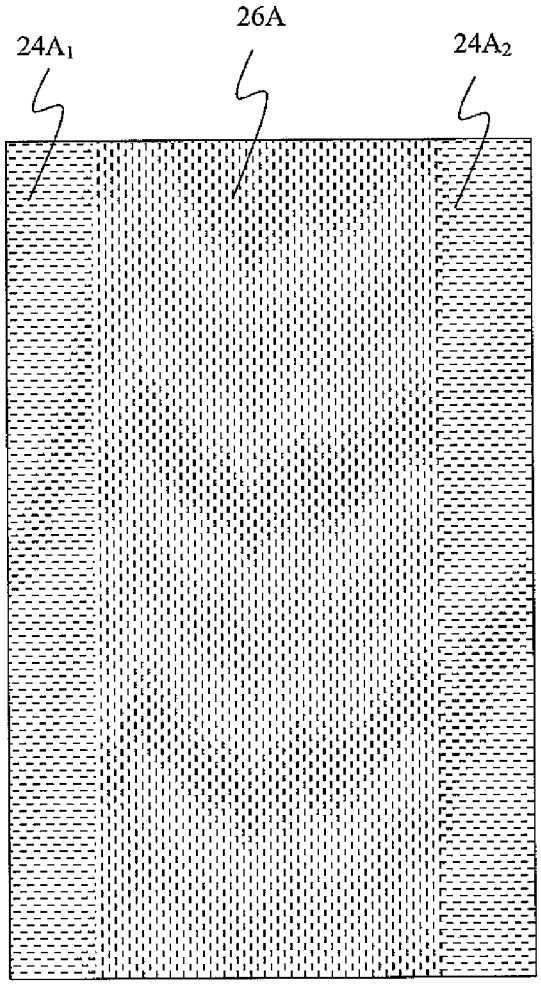
Figure 1B:
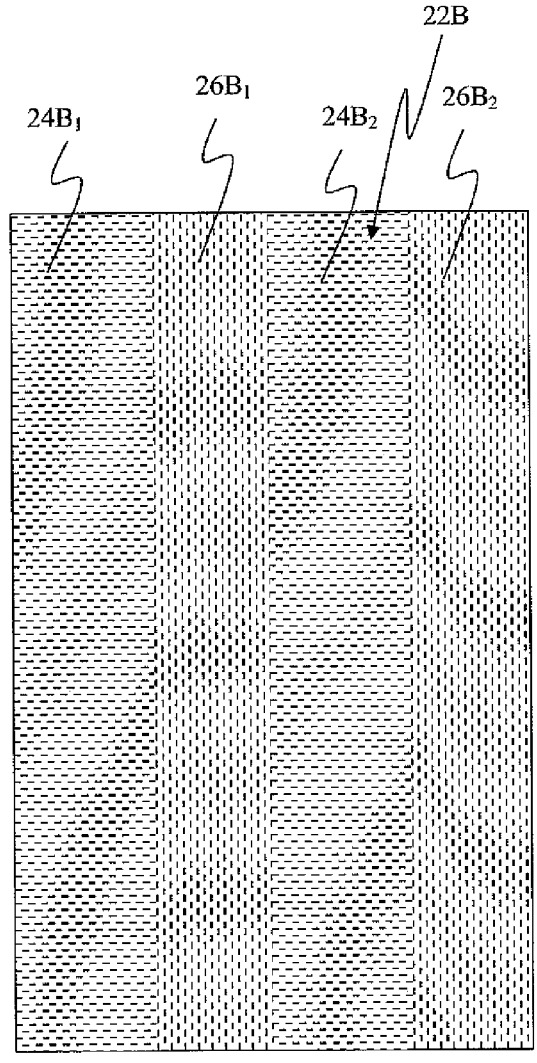
Figure 1C:
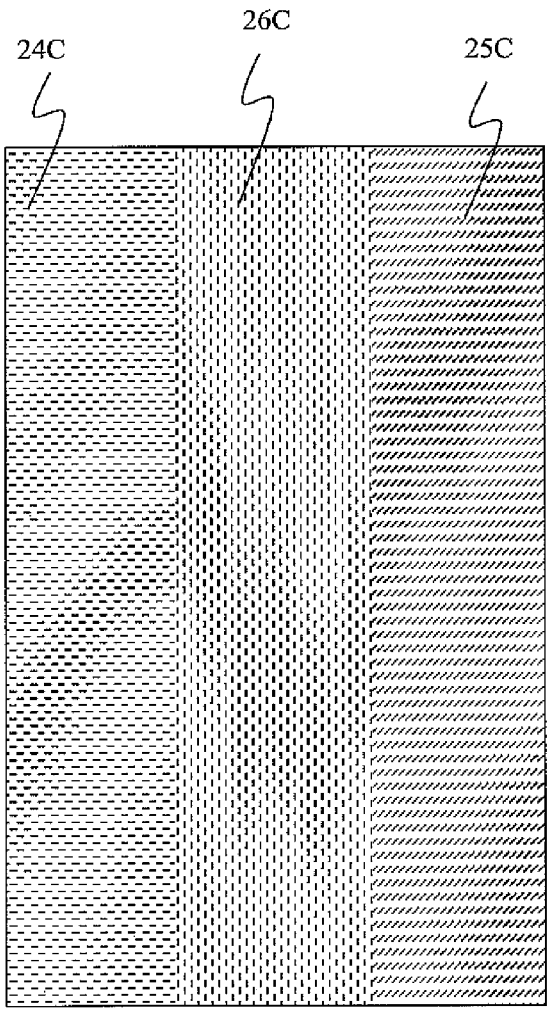
Figure 1D:
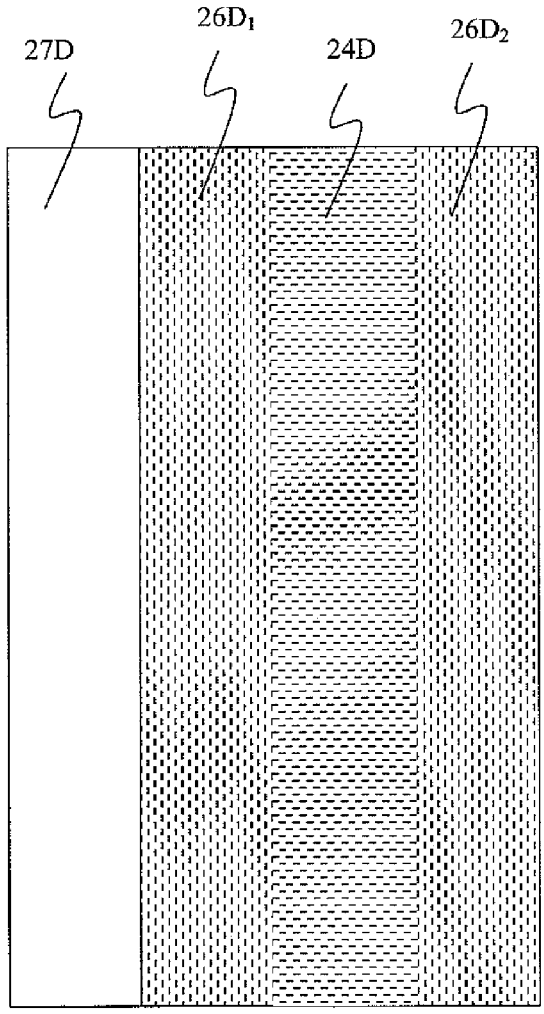

The graphic design of wood grains in the universal master board 20 of FIG. 1 is a representative example of the various graphic design patterns that may be formed in the universal master board 20. FIG. 1A depicts an alternative graphic design of a universal master board 20A in which first wood grain patterns 24$A_1$ and 24$A_2$ at the opposite lateral surface regions of the expansive surface are horizontal wood grain patterns, and a second wood grain pattern 26A between the opposite lateral surface regions of the expansive surface is a vertical wood grain pattern. FIG. 1B depicts a universal master board 20B with another graphic design having an expansive surface 22B with alternative columns of horizontal first grain wood patterns 24$B_1$ and 24$B_2$ and vertical second wood grain patterns 26$B_1$ and 24$B_2$. Many other graphic design are possible For example, the first and/or second wood grain patterns may extend at an oblique angle relative to the edges of the universal master board, i.e., as neither horizontal or vertical wood grain patterns. The universal master board may include third, fourth, fifth, or additional wood grain patterns. FIG. 1C depicts an embodiment of a universal master board 20C having a horizontal first grain pattern 24C, a vertical second grain pattern 26C, and a diagonal third grain pattern 25C. Optionally, one or more regions of the universal master board may be free of (that is, without) a wood grain pattern. For example, FIG. 1D depicts an embodiment of a universal master board 20D having a first horizontal grain pattern 24D, second vertical grain patterns 26$D_1$ and 26$D_2$, and a third blank area 27D free of any grain pattern.

The universal master board 20 may be made of various materials, including materials commonly used in the building industry for door skins. Examples of suitable materials are medium density fiberboard ("MDF") and high density fiberboard containing a thermosetting resin and cellulosic fibers/particles such as wood. Generally, fiberboard materials contain from about 88 weight percent to about 98 weight percent cellulosic fiber, and from about 2 to about 10 weight percent thermosetting resin. Other materials such as waxes, fire retardants, and other additives may be included as well. Alternative materials that may be selected include sheet molding compounds (SMC), SMC-fiberglass composites, and metal, in particular steel. The universal master board 20 optionally may include one or more coatings and protective layers on its expansive surface, such as described for example in U.S. Pat. No. 6,335,082. As described in the aforementioned patent, the coating or coatings may contain pigments, release agents, resins, additives, etc.

Many different methods of manufacturing composites are known in the art. The principal processes for the manufacture of fiberboard include: (a) wet felted/wet pressed or "wet" processes; (b) dry felted/dry pressed or "dry" processes; and (c) wet felted/dry pressed or "wet-dry" processes. Synthetic binder resins, such as amino resins, urea-formaldehyde resins, phenol-formaldehyde resins, or modified phenol-formaldehyde resins, are often used as binders in these processes. Other binders include, but are not limited to, starches, asphalt, gums, and multi-functional isocyanates. An example of a multi-functional isocyanate-based composite material is disclosed in U.S. Pat. No. 5,344,484 to Walsh.

Cellulosic fibers such as, for example, wood fibers are prepared by the fiberization of woody chip material in a pressurized refiner, an atmospheric refiner, a mechanical refiner, and/or a thermochemical refiner. Generally, in a wet process, the cellulosic fibers are blended in a vessel with large amounts of water to form a slurry. The slurry preferably has sufficient water content to suspend a majority of the wood fibers, such as a water content of at least 95 percent by weight (wt %). The water is used to distribute a synthetic resin binder, such as a phenol-formaldehyde resin over the wood fibers. This mixture is deposited onto a water-pervious support member, such as a fine screen or a Fourdrinier wire, and pre-compressed, whereby much of the water is removed to leave a wet mat of cellulosic material having, for example, a moisture content of at least about 50 wt % based on the weight of dry cellulosic material. The wet mat is transferred to a press and consolidated under heat and pressure to form the molded composite board.

A wet-dry forming process can also be used to produce composites. A wet-dry process typically begins by blending cellulosic material (e.g., wood fibers) in a vessel with a large amount of water. This slurry is then blended with a resin binder. The blend is then deposited onto a water-pervious support member, where a large percentage (e.g., about 50 wt % or more) of the water is removed, thereby leaving a wet mat of cellulosic material having a water content of about 40 wt % to about 60 wt %, for example. This wet mat is then transferred to a zone where much of the remaining water is removed by evaporation by heat to form a dried mat. The dried mat preferably has a moisture content of about 10 wt % or less. The dried mat can be finished at this point or transferred to a press and consolidated under heat and pressure to form a higher density composite board.

In a dry forming process, filler material, such as cellulosic fibers, is generally conveyed in a gaseous stream or by mechanical means. For example, the fibers supplied from a fiberizing apparatus (e.g., a pressurized refiner) may be coated with a thermosetting synthetic resin, such as a phenol-formaldehyde resin, in a blowline blending procedure, wherein the resin is blended with the fiber with the aid of air turbulence. Thereafter, the resin-coated fibers from the blowline can be randomly formed into a mat by air blowing the fibers onto a support member. Optionally, the fibers, either before or after formation of the mat, can be subjected to pre-press drying, for example in a tube-like dryer. The formed mat, typically having a moisture content of less than about 10 wt %, and preferably about 5 wt % to about 10 wt %, then is pressed under heat and pressure to cure the thermosetting resin and to compress the mat into an integral consolidated board.

As an alternative to conventional pressing, steam injection pressing is a consolidation step that can be used, for example, under certain circumstances in the dry and wet-dry process production of consolidated cellulosic composites. In steam injection pressing, steam is injected through perforated heating press platens, into, through, and then out of a mat that includes the synthetic resin and the filler material. The steam condenses on surfaces of the filler and heats the mat. The heat transferred by the steam to the mat as well as the heat transferred from the press platens to the mat cause the resin to cure.

The first and second wood grain patterns 24, 26 can be formed in the expansive surface 22 of the universal master board 20 during mat compression, or via post-forming or embossing. The patterns may have a depth of, for example, about 3 mils (0.003 inch) to about 45 mils (0.045 inch). The depth, width, and length of the depressions will vary depending on the substrate material and the wood species being simulated. Depressions may be variably spaced throughout the expansive surface 22 and may be variable sized.

A pressing die corresponding to the expansive surface of the universal master board 20 is provided with a mold die surface having an inverse relationship to the wood grain patterns. Alternatively, an embossing plate may be used. To make the embossing plate or mold die surface, images of natural pieces of wood are captured using conventional photography methods or may be derived using digital imaging techniques. A plurality of wood boards may be photographed, each for a corresponding surface region of the universal master board. The wood patterns may be of the same or different wood species. The image is altered using either conventional photographic arts or using computer imaging. An inverse of the photographic image of the grain pattern is then transferred to the mold die surface or embossing plate, typically using an etching process. Examples of an embossing plate and embossing process are disclosed, for example, in U.S. Pat. Nos. 7,367,166 and 7,338,612. It should be understood that embodiments of the present invention may involve the use and practice of etching plates and etching techniques other than those described in the aforementioned patents. The present invention encompasses the use of techniques and equipment other than embossing and embossing plates.

According to an embodiment of the invention, to form the universal master board 20, a blank or substrate may be embossed by subjecting it to selected amounts of heat and pressure for a pressing time. Equipment and processing conditions for pressing and post-pressing medium density fiberboard and other particle board are known in the art and described throughout the literature, including, for example, in U.S. Pat. Nos. 6,868,644, 6,471,897, and 6,335,082. When embossing a material used to form a universal master board 20 having wood grain patterns, the etched embossing plate or die set is pressed into the blank to provide the appearance and texture of simulated bundles of wood ticks that form the grain pattern on the resulting door skin surface. A wood grain pattern is a cluster or bundle of spaced, embossed lines, or "ticks", which extend in a pattern simulating the appearance of wood. The resulting ticks simulate the soft, flowing appearance of natural wood grain. The embossed simulated wood grain pattern optionally may also include tonal portions as described in the above-mentioned U.S. Pat. Nos. 7,367,166 and 7,338,612.

While the formation of the simulated wood grain patterns is discussed above with regard to embossment and similar pressing operations, it should be understood that uniform wood grain patterns may be reproducibly formed in the surface of multiple universal master boards 20 using other techniques, such as laser etching.

Figure 2:
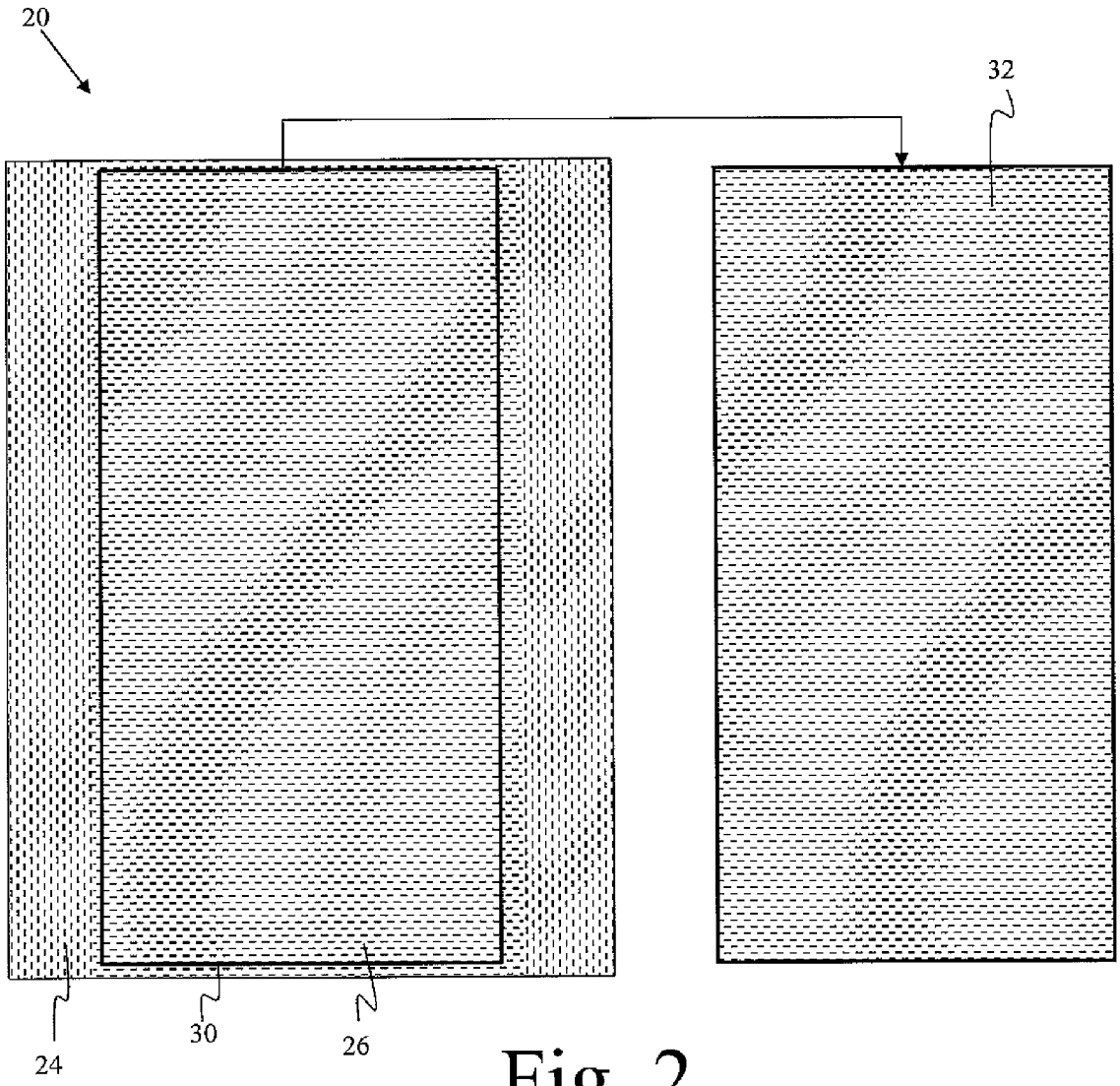
FIG. 2 is an elevational view depicting selecting and cutting operations for making a flush door skin having an assortment of a wood grain pattern from the universal master board of FIG. 1, according to an embodiment of the invention.

FIG. 2 depicts an exemplary embodiment in which a flush door skin 32 is prepared from the universal master board 20 of FIG. 1. In FIG. 2, the width of the universal master board 20 is greater than the preselected width of the flush door skin 32, yet less than the twice the width of the flush door skin 32. More specifically, the second wood grain pattern 26 region is approximately equal or slightly larger in width than the width of the flush door skin 34. The height of the universal master board 20 is at least as great as the preselected height of the flush door skin 32. A hypothetical cutting template or box 30 may be positioned any place on the universal master board 20 to select an arrangement or assortment of simulated horizontal and/or vertical wood grain for the flush door skin 32. In the embodiment of FIG. 2, an exclusively horizontal wood grain pattern assortment is selected by placing, or more specifically superimposing, the hypothetical cutting template 30 over the middle portion of the expansive surface 22 of the universal master board 20, completely within the boundaries of the surface region of the universal master board 20 corresponding to the second wood grain pattern 26. The door skin 32 having an edge commensurate with the boundary of the hypothetical cutting template 30 is cut from the universal master board 20. Any suitable cutting procedure and equipment may be used, including for example the use of manual and automated mechanical tools, stamps, and lasers. The resulting door skin 32 of FIG. 2 has an exterior surface with an assortment of a simulated horizontal wood grain pattern across its entire exterior surface.

Figure 3:
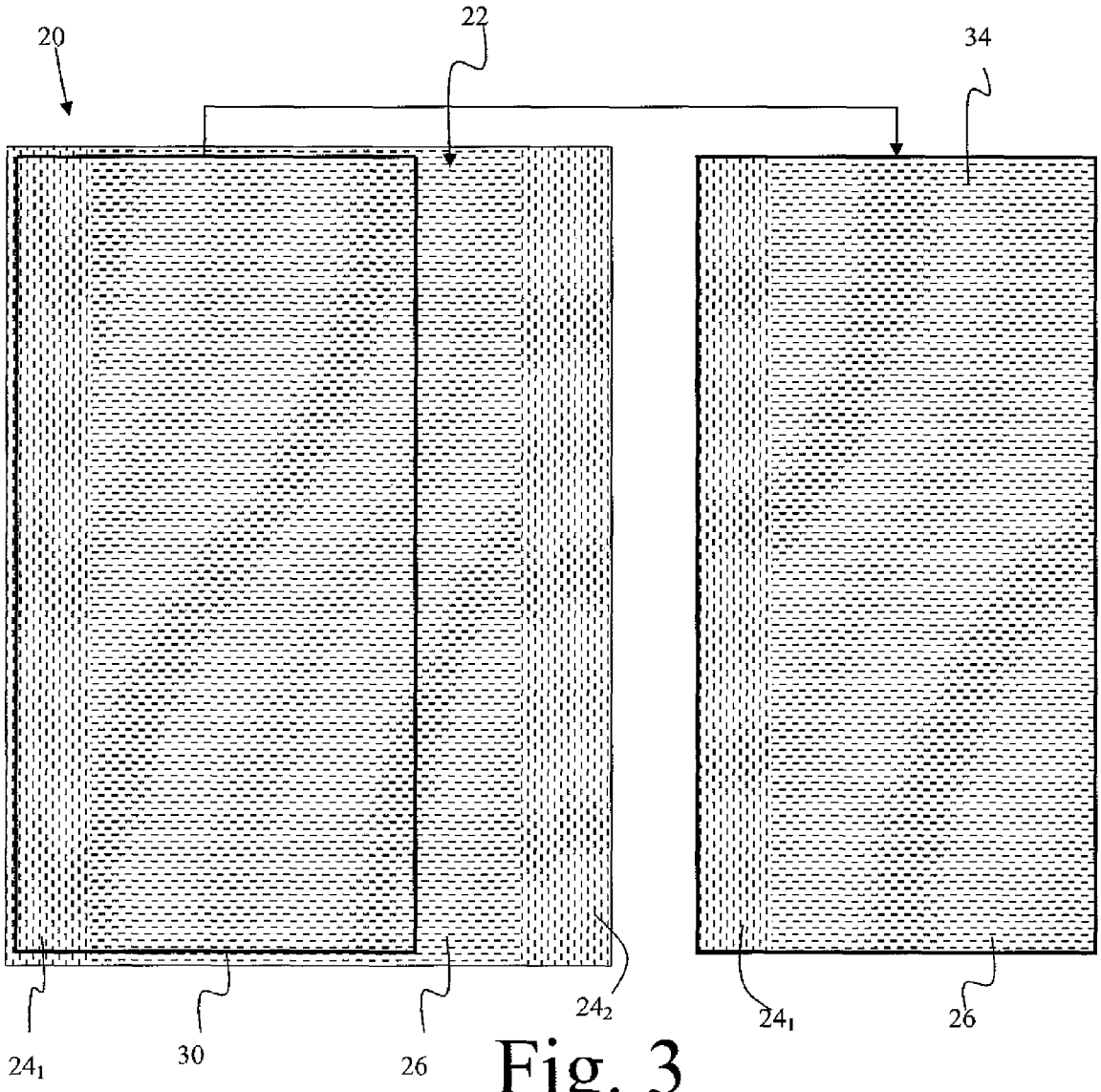
FIG. 3 is an elevational view depicting the selecting and cutting operations for making a flush door skin having an assortment of wood grain patterns from the universal master board of FIG. 1, according to another embodiment of the invention.

FIG. 3 depicts an exemplary embodiment in which a flush door skin 34 is prepared from a substantially identical universal master board 20 as used in FIG. 2. The universal master boards 20 of FIGS. 2 and 3 each have substantially identical graphic designs composed of vertical wood grain patterns at their lateral sides and a horizontal wood grain pattern there between. It should be understood that inconsistencies in molding conditions and steps may result in minor variations between substantially identical universal master boards 20 prepared in the same mold die with the same embossing patterns. Overall, however, the assortment of horizontal and vertical wood grain patterns on the expansive surfaces 22 of the boards is uniform with respect to one another.

In FIG. 3, the width of the universal master board 20 is again greater than (but less than twice as great as) the predetermined width of the flush door skin 34. In the embodiment of FIG. 3 the hypothetical cutting template 30 is selectively positioned towards the left edge of the universal master board 20 and thereby superimposed over a portion of the expansive surface 22 including both the vertical first wood grain pattern $\mathbf{24}_1$ and the horizontal second wood grain pattern 26. The door skin 34 having an edge commensurate with the boundary of the hypothetical cutting template 30 is cut from the universal master board 20. The resulting door skin 34 has an exterior surface with a simulated vertical wood grain pattern 24, along one of its sides and a simulated horizontal wood grain pattern 26 over the remainder and vast majority of the exterior surface of the flush door skin 34.

Figure 4:
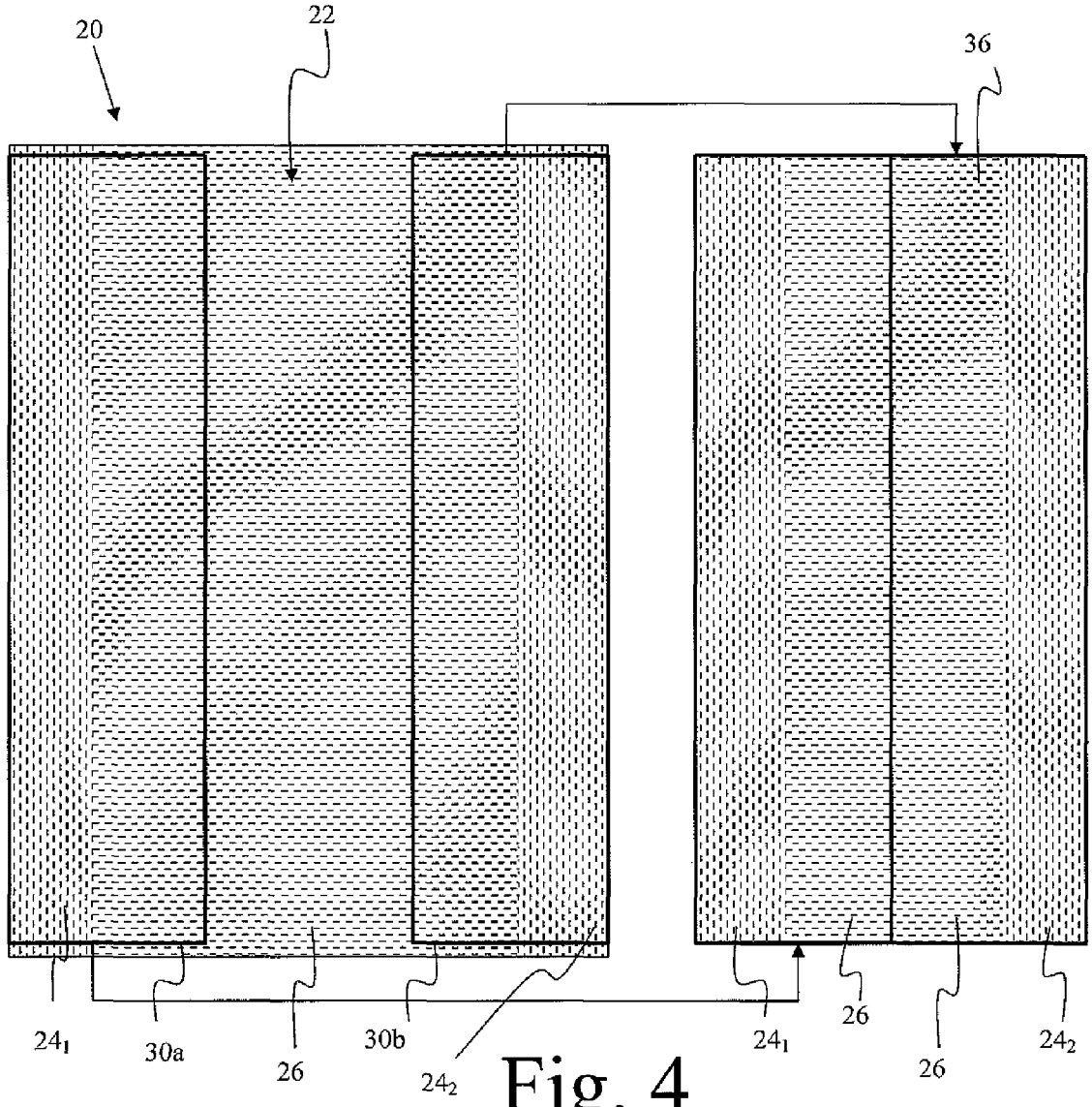
FIG. 4 is an elevational view depicting selecting, cutting, and joining operations for making a flush door skin having an assortment of wood grain patterns from the universal master board of FIG. 1, according to an embodiment of the invention.

FIG. 4 depicts an exemplary embodiment in which a flush door skin 36 is prepared from a substantially identical universal master board 20 as used in FIGS. 2 and 3. In FIG. 4, the width of the universal master board 20 is again greater than the predetermined width of the flush door skin 36. In the embodiment of FIG. 4 first and second hypothetical cutting templates 30*a* and 30*b* are respectively positioned towards the left and right edges of the universal master board 20. The first hypothetical cutting template 30*a* is thereby superimposed over a portion of the expansive surface 22 containing both the left vertical first wood grain pattern $\mathbf{24}_1$ and a portion of the horizontal second wood grain pattern 26. The second hypothetical cutting template 30*b* is thereby superimposed over a portion of the expansive surface containing both the right vertical first wood grain pattern $\mathbf{24}_2$ and part of the horizontal second wood grain pattern 26. Door skin halves having edges commensurate with the boundaries of the hypothetical cutting templates 30*a* and 30*b* are cut from the universal master board 20. The door skin halves are then joined together along their respective edges to provide a resulting door skin 36 having an exterior surface with simulated vertical wood grain patterns $\mathbf{24}_1$, $\mathbf{24}_2$ along its opposite lateral sides and the simulated horizontal wood grain pattern 26 over the remainder of the exterior surface of the door skin 36. Any suitable adhesive or mechanical fastener may be used to join the door skin halves together. The joining may be performed at such time when the door skin halves are attached to their frame by individually bonding or otherwise securing the door skin halves to the frame in side-by-side relationship with one another.

Figure 5:
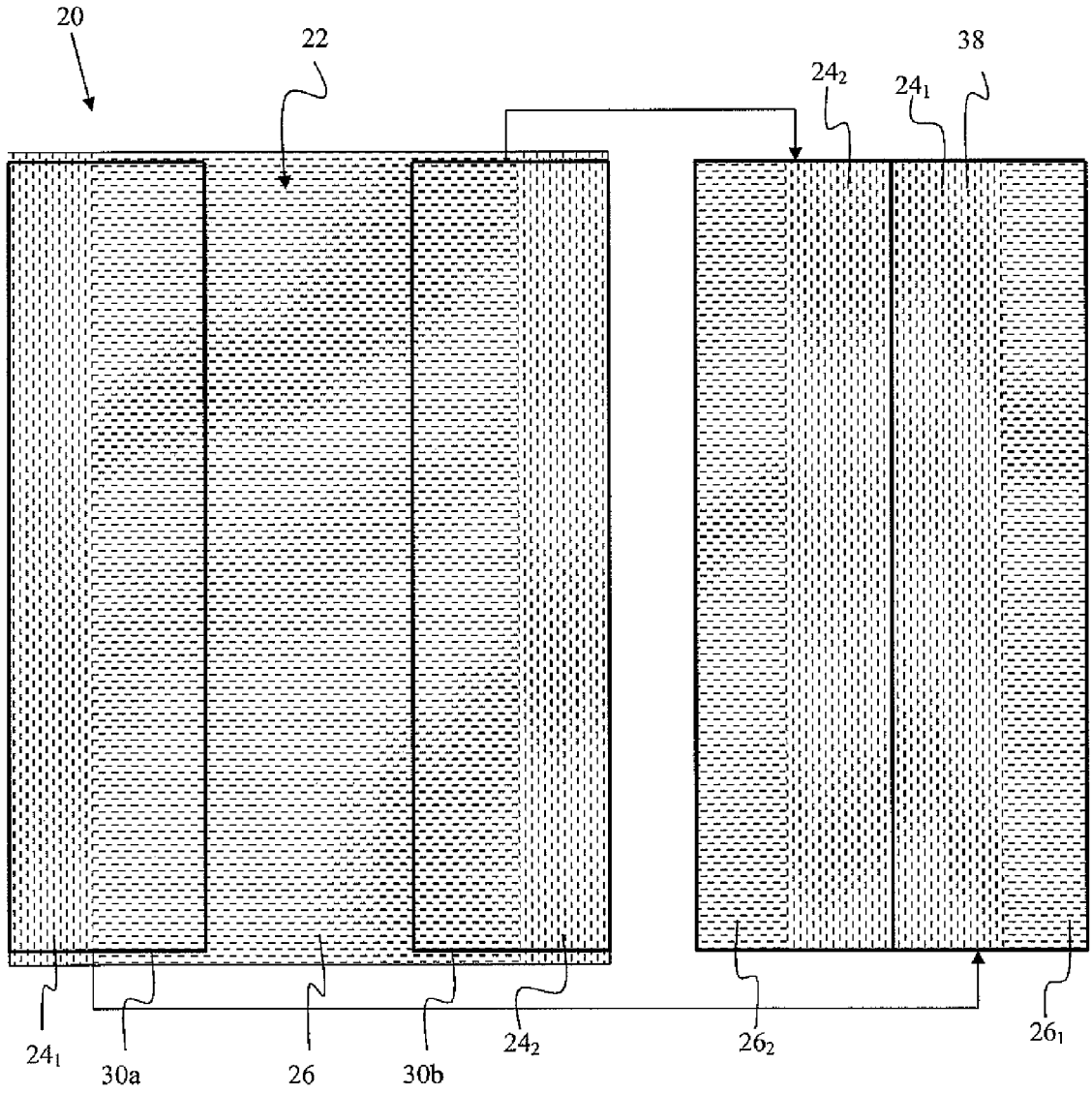
FIG. 5 is an elevational view depicting selecting, cutting and joining operations for making a flush door skin having an assortment of wood grain patterns from the universal master board of FIG. 1, according a further embodiment of the invention.

FIG. 5 depicts an embodiment similar to FIG. 4, except that the door skin halves are transposed with one another before being joined together into door skin 38. That is, the outer edges of the door skin halves, corresponding to the opposite edges of the universal master board 20, are joined to one another. The exterior surface of the resulting door skin 38 has simulated horizontal wood grain patterns $\mathbf{26}_1$ and $\mathbf{26}_2$ at its opposite lateral side regions, and a simulated vertical wood grain pattern $\mathbf{24}_1$, $\mathbf{24}_2$ between the opposite lateral side regions.

Figure 6:
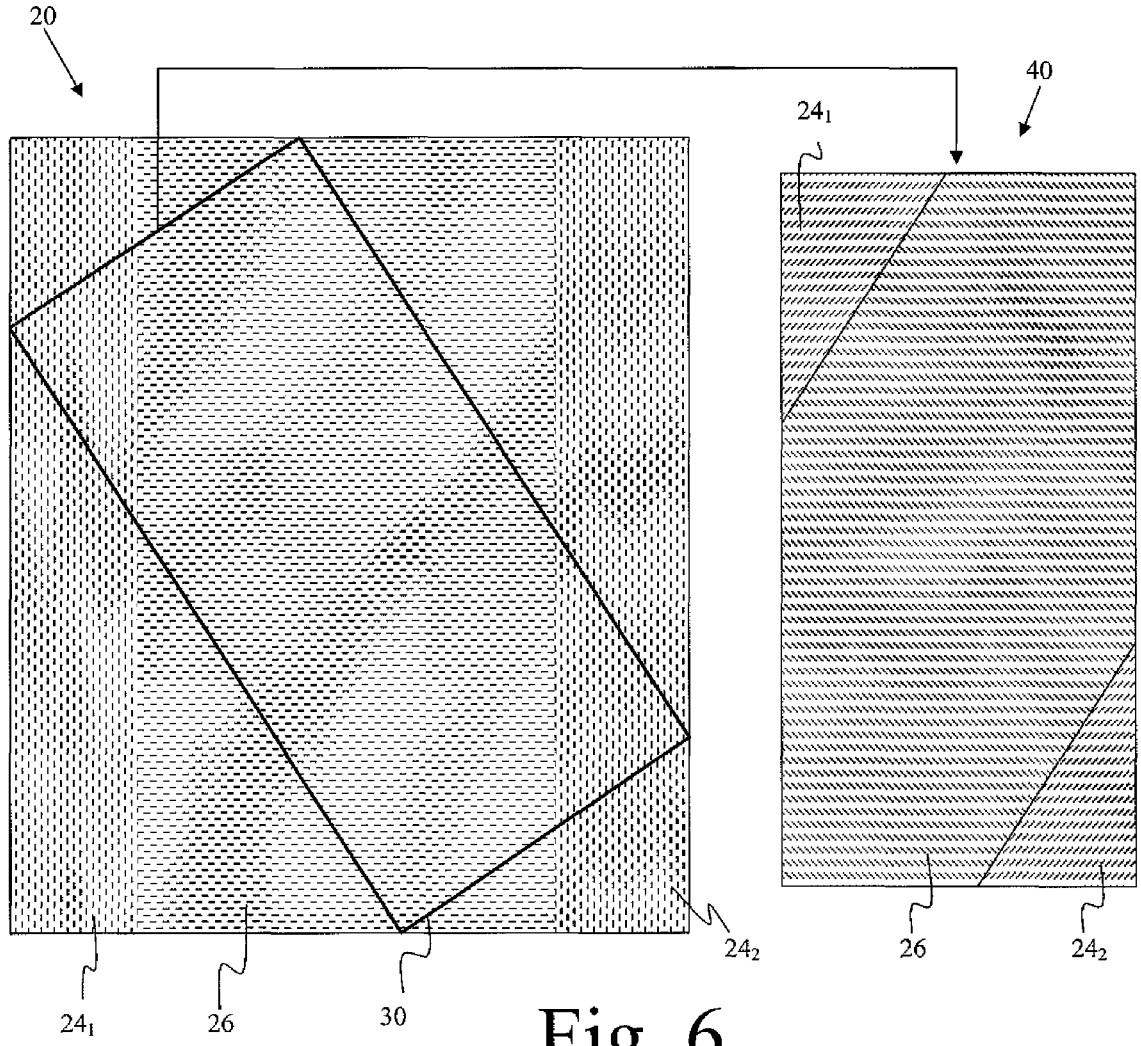
FIG. 6 is an elevational view depicting selecting and cutting operations for making a flush door skin having an assortment of wood grain patterns from the universal master board of FIG. 1, according to another embodiment of the invention.

FIG. 6 depicts still another embodiment in which a flush door skin 40 is prepared from a substantially identical universal master board 20 as used in FIGS. 2-5, the universal master board 20 having first vertical wood grain patterns $\mathbf{24}_1$ and $\mathbf{24}_2$ and a second horizontal wood grain. The height and width dimensions of the universal master board 20 selected for the embodiment of FIG. 6 may be larger than those of the universal master boards of FIGS. 2-5 for reasons that will become evident below. The hypothetical cutting template 30 having dimensions equal to the desired dimensions of the flush door facing 40 is obliquely angled or slanted relative to the universal master board 20 in FIG. 6 so that the top and bottom edges of the hypothetical cutting template 30 are skewed with respect to the top and bottom edges of the universal master board 20. The flush door skin 40 having an edge commensurate with the boundary of the hypothetical cutting template 30 is cut from the universal master board 20. The resulting door skin 40 has an exterior surface with slanted wood grain patterns. The wood grain pattern $\mathbf{24}_1$, $\mathbf{24}_2$ of the upper left and lower right corners of the flush door skin 40 extends generally perpendicular to the wood grain pattern 26 over the central portion of the flush door skin 40.

Figure 7:
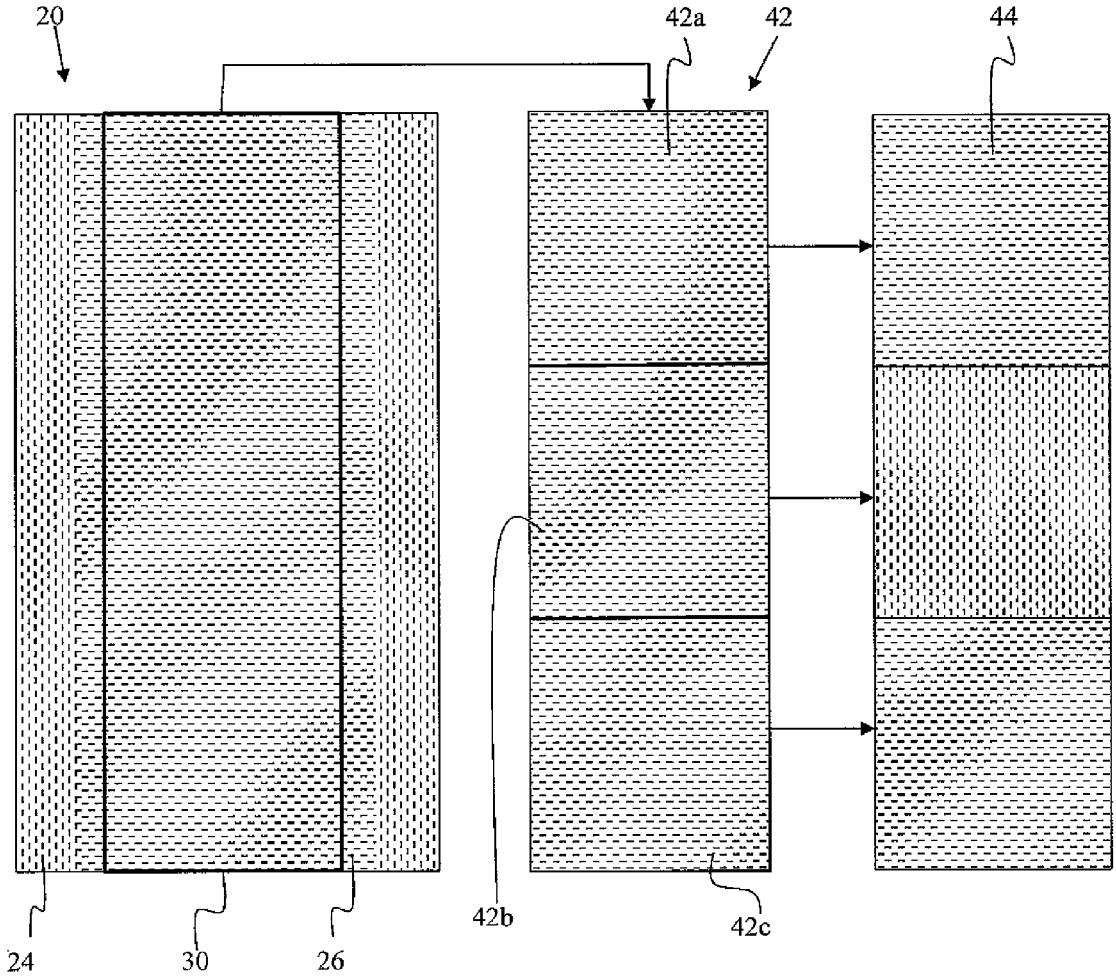
FIG. 7 is an elevational view depicting selecting, cutting and joining operations for making a flush door skin having an assortment of wood grain patterns from the universal master board of FIG. 1, according to still another embodiment of the invention.

FIG. 7 depicts an exemplary embodiment in which a flush door skin 44 is prepared from the universal master board 20 of FIG. 1. In FIG. 7, the second wood grain pattern 26 region is again approximately equal or slightly larger in width than the intended width of the flush door skin 44. The height of the universal master board 20 is equal to or greater than the preselected height of the flush door skin 44. In the embodiment of FIG. 7, an assortment of exclusively horizontal wood grains is selected by superimposing the hypothetical cutting template 30 over a middle portion of the expansive surface 22 of the universal master board 20, completely within the boundaries of the surface region of the universal master board 20 corresponding to the second wood grain pattern 26. The universal master board 20 is cut along the boundary of the hypothetical cutting template 30 to provide an intermediate door skin 42, which is then cut horizontally into three equal sections 42*a*, 42*b*, and 42*c*. The middle section 42*b* is rotated 90 degrees while the orientation of the outer sections 42*a* and 42*c* is maintained. The sections 42*a*, 42*b*, and 42*c* are then rejoined to one another to create the flush door skin 44 having an exterior surface with simulated horizontal wood grain patterns over the top third and bottom third surface sections, and a simulated vertical wood grain pattern over the middle surface section. Any suitable cutting procedure and equipment may be used, including for example the use of manual and automated mechanical devices or lasers. It should be understood that alternative patterns can be formed. For example, sections 42*a* and 42*c* may be rotated while the orientation of section 42*b* is maintained unchanged. Alternatively, the intermediate door skin 42 may be cut along different lines and into alternative shapes than shown. These represent just a sampling of the variations and modifications that may be practiced with respect to this and other embodiments described herein.

Figure 8:
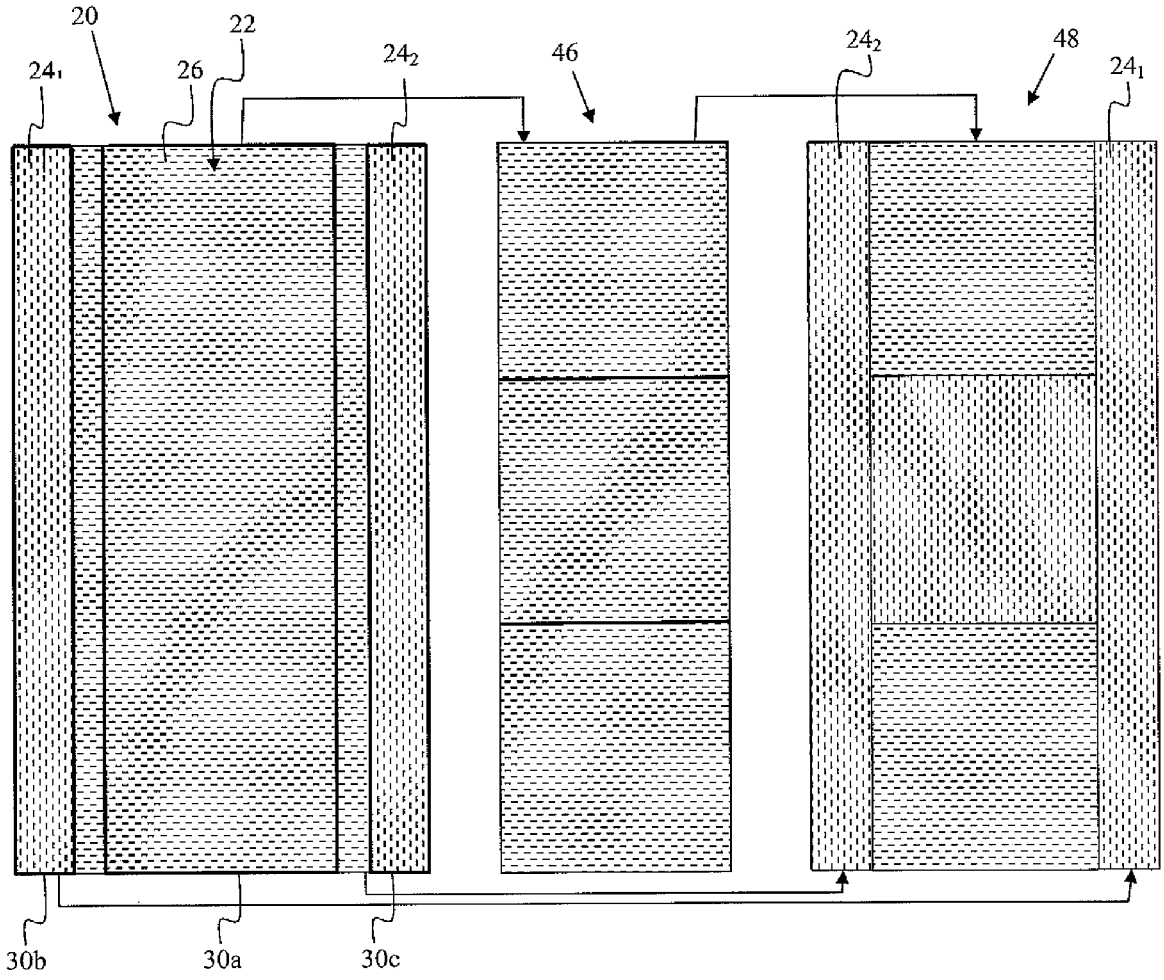
FIG. 8 is an elevational view depicting selecting, cutting and joining operations for making a flush door skin having an assortment of wood grain patterns from the universal master board of FIG. 1, according to still a further embodiment of the invention.

FIG. 8 represents an operation in which a flush door skin 48 is prepared from the universal master board 20 of FIG. 1 using more than one hypothetical cutting template 30*a*, 30*b*, and 30*c*. In the embodiment of FIG. 8, an exclusively horizontal wood grain pattern assortment is selected by superimposing the first hypothetical cutting template 30*a* over a middle portion of the exterior surface 22 of the universal master board 20, completely within the boundaries of the surface region of the universal master board 20 corresponding to the second wood grain pattern 26. The universal master board 20 is cut along the boundary of the first hypothetical cutting template 30*a* to provide an intermediate door skin portion 46. Additionally, second and third hypothetical cutting templates 30*b*, 30*c* are superimposed over the vertical wood grain patterns $24_1$, $24_2$ at the opposite sides of the universal master board 20, and the universal master board 20 is further cut along the boundaries of the second and third cutting templates 30*b* and 30*c* to provide end door skin portions having vertical grain patterns $24_1$ and $24_2$.

In a manner described above with respect to FIG. 7, in the operation of FIG. 8 the intermediate door skin portion 46 is cut horizontally into three equal sections, and the middle section is rotated 90 degrees while the orientation of the top and bottom sections is maintained. The sections are then rejoined to one another as described above to provide what will be the middle portion of the flush door skin 48 having horizontal wood grain patterns over the top and bottom thirds of its surface area, and a vertical wood grain pattern there between. The end door skin portions $24_1$, $24_2$ corresponding to cutting templates 30*b* and 30*c* are then secured to the opposite sides of the middle portion to provide the flush door skin 48 with vertical wood grain patterns extending along the length of the opposite lateral sides of the flush door skin 48.

The above detailed description of exemplary embodiments and drawing FIGS. 1-8 collectively demonstrate a particularly advantageous feature of certain exemplary embodiments of the invention. Substantially identical universal master boards, e.g., 20, having uniform embossments of wood grain patterns can be made into flush door skins having assortments of simulated wood grain patterns that differ from one door skin to the next. As a consequence, a single mold die or embossing plate design can be used to make substantially identical universal master boards that in turn serve as precursors for making of door skins having substantially different assortments of wood grain patterns, such as shown in FIGS. 2-8. The expense and labor of preparing a different embossing plate or etched mold die set for each design assortment can be eliminated.

Figure 9:
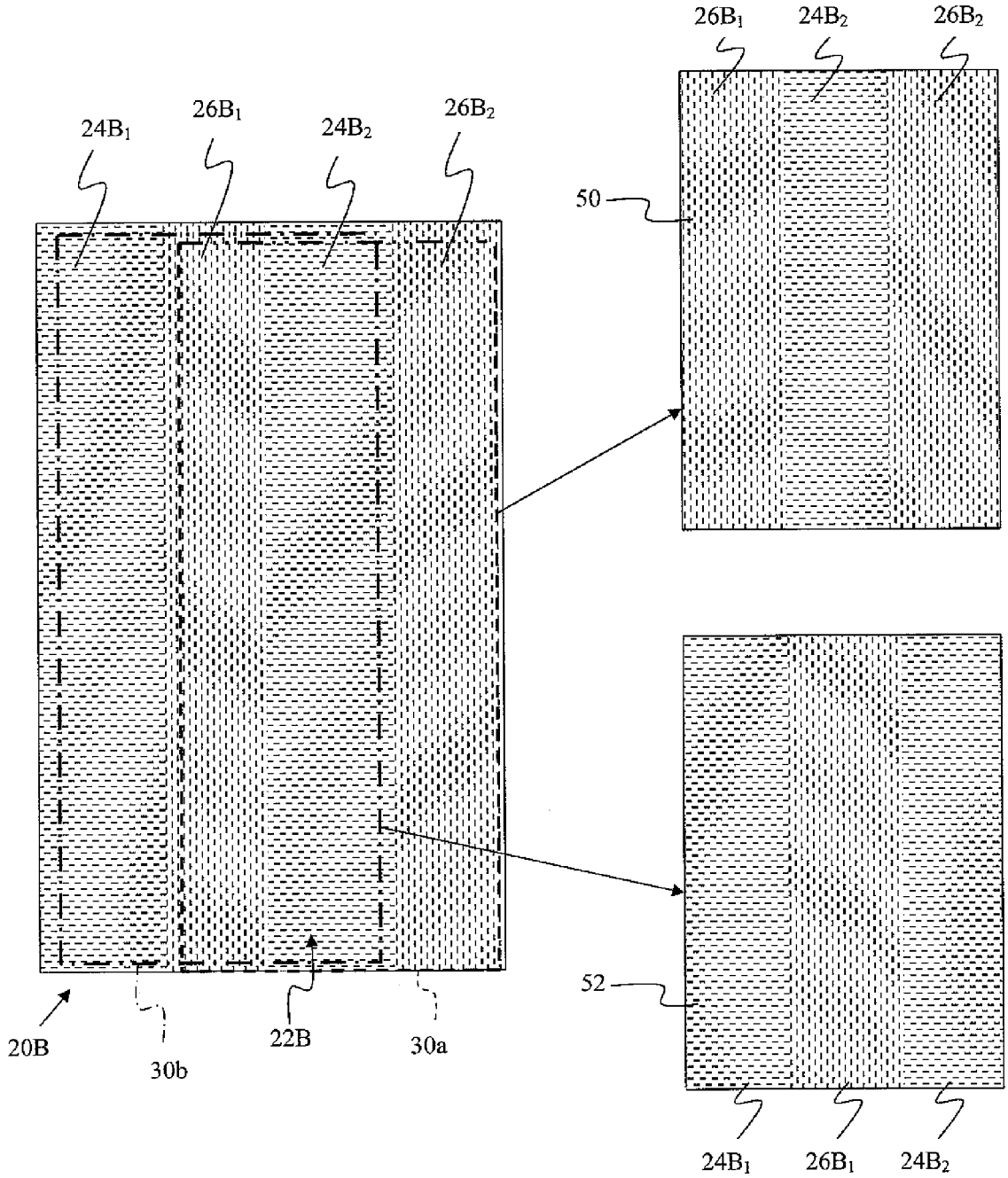
FIG. 9 is an elevational view depicting selecting and cutting operations for making flush door skins (shown in fragmentary views) having respective assortments of wood grain patterns from the universal master board of FIG. 1B, according to still further embodiments of the invention.

FIG. 9 shows another exemplary embodiment of the invention in which flush door skins having different respective wood grain pattern assortments are prepared from substantially identical universal master boards 20B discussed above in connection with FIG. 1B.

In FIG. 9, a first hypothetical cutting template 30*a* is positioned towards a right portion of the expansive surface 22B of the universal master board 20B so as to be superimposed over one of the horizontal first wood grain patterns $24B_2$ and both of the vertical second wood grain patterns $26B_1$ and $26B_2$. A flush door skin 50 having an edge commensurate with the boundary of the hypothetical cutting template 30*a* is cut from the universal master board 20B. The flush door skin 50 has an exterior surface with simulated vertical wood grain patterns $26B_1$, $26B_2$ along it opposite lateral sides and a simulated horizontal wood grain pattern $24B_2$ over the remainder of the exterior surface of the flush door skin 50.

A second hypothetical cutting template 30*b* is positioned towards a left portion of the expansive surface 22B of the universal master board 20B in FIG. 9 and thereby superimposed over both of the horizontal first wood grain patterns $24B_1$ and $24B_2$ and one of the vertical second wood grain patterns $26B_1$. A flush door skin 52 having an edge commensurate with the boundary of the hypothetical cutting template 30*b* is cut from the universal master board 20B. The flush door skin 52 has an exterior surface with simulated horizontal wood grain patterns $24B_1$, $24B_2$ along its opposite lateral side areas and a simulated vertical wood grain pattern $26B_1$ over the remainder of the exterior surface area of the door skin 50, i.e., between the lateral side regions.

Notably, the first and second hypothetical cutting templates 30*a*, 30*b* encompass overlapping areas of the expansive surface 22B, such that the flush door skins 50 and 52 share a common region (i.e., parts of the vertical wood grain pattern $26B_1$ and the horizontal wood grain pattern $24B_2$) of the graphic design on the universal master boards 20B. It should be understood that the hypothetical template 30*a* or 30*b* may be selectively positioned at other positions on the expansive surface 22B as well to select from multiple other possible choices of assortments of wood grain patterns $24B_1$, $24B_2$, $26B_1$ and/or $26B_2$. The presentation of these multiple design options within the limited surface area of the universal master board constitutes a judicious use of resources and significant cost and labor savings.

Figure 10:
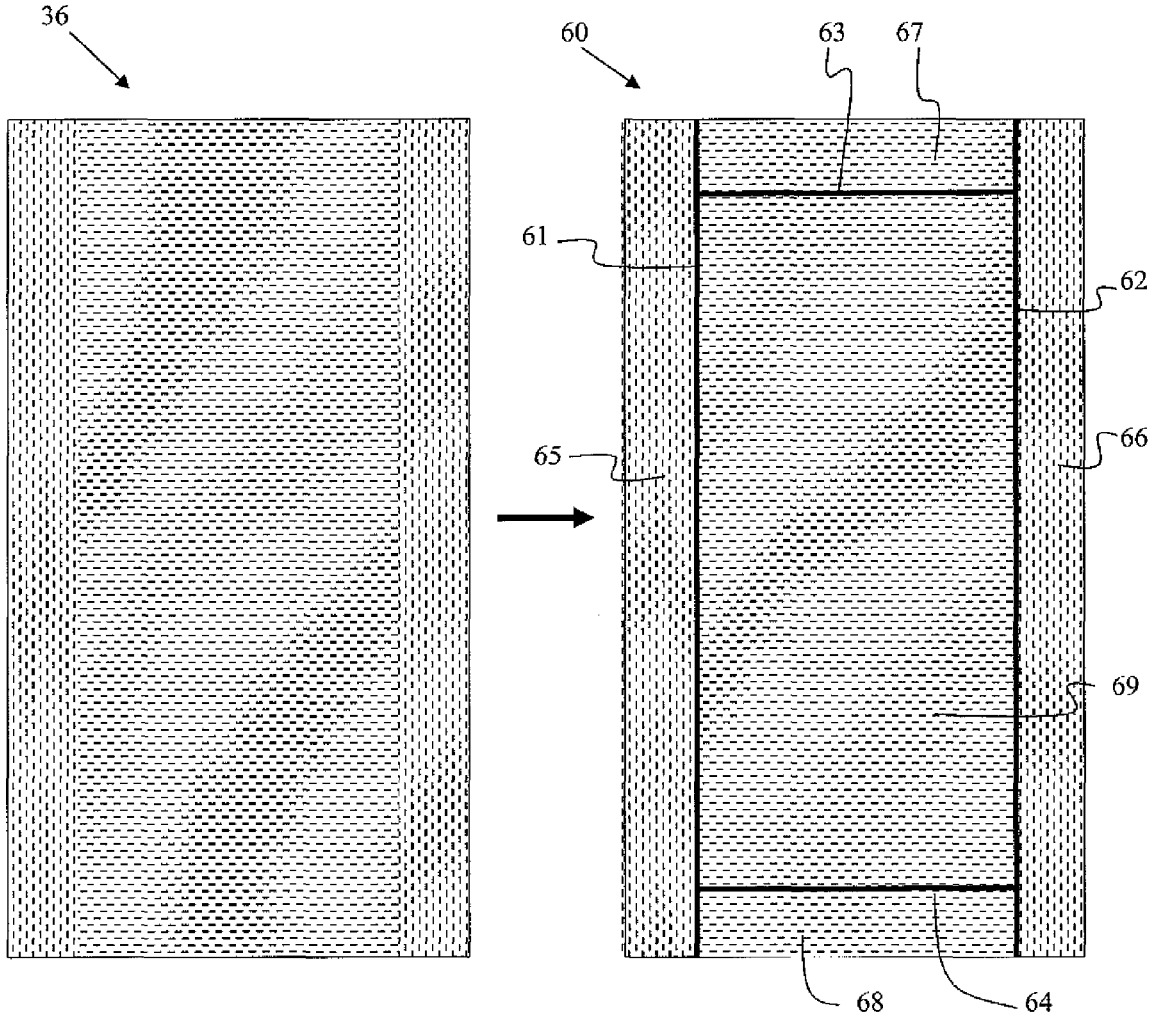
FIG. 10 is an elevational view depicting the demarcation of an exterior surface of a flush door skin into a plurality of ornamental features to establish an ornamental surface design, according to an embodiment of the invention.

FIG. 10 illustrates the transformation of a flush door skin 36 similar to that of FIG. 4 cut from the universal master board 20 into a flush door skin 60. The expansive surfaces of the flush door skins 36, 60 both have a graphic design of first depressions substantially parallel to one another and substantially aligned in a vertical direction to simulate vertical wood grain patterns along the opposite lateral side regions of the flush door skins 36, 60, and second depressions that are substantially parallel to one another and substantially aligned in a horizontal direction to simulate a horizontal wood grain pattern over the remaining exterior surface region of the flush door skins 36, 60, i.e., between the lateral side regions.

Markings 61, 62, 63, and 64 demarcate the exterior surface of the flush door skin 60 into a plurality of ornamental surface features 65, 66, 67, 68, and 69. The markings 61, 62, 63, and 64 of the embodiment of FIG. 10 (and the markings 71-73, 81-83, and 99 of the other embodiments depicted in FIGS. 11-13 discussed below) may comprise a groove or the like in the exterior surface of the flush door skin 60. Machine and lasing engraving are exemplary techniques for forming the markings 61, 62, 63, 64, etc. The formed groove may be contoured to include beads, steps, and other designs typically found in milled woodwork. Alternatively, the markings 61, 62, 63, 64, etc. may be printed on the exterior surface of the flush door skin 60 using ink jet or laser printing, for example.

The first vertical mark 61 extends along the length of the flush door skin 60 of FIG. 10 between the vertical wood grain pattern on the left side of the flush door skin 60 and the horizontal wood grain pattern at the center area of the flush door skin 60. The first vertical mark 61 and the vertical wood grain pattern on the left side of the flush door skin 60 combine to establish an ornamental surface design of a first stile 65. Similarly, the second vertical mark 62 extends along the length of the flush door skin 60 between the vertical wood grain pattern on the right side of the door skin 60 and the horizontal wood grain pattern at the center area of the flush door skin 60. The second vertical mark 62 and the vertical wood grain pattern on the right side of the flush door skin 60 combine to establish an ornamental surface design of a second stile 66.

A first horizontal mark 63 extends perpendicularly between the vertical marks 61, 62 proximate to the upper edge of the door skin 60. Unlike the vertical marks 61, 62, the first horizontal mark 63 is not at a boundary of horizontal and vertical simulated grain patterns. The first horizontal mark 63 and the horizontal wood grain pattern proximate to the top of the door skin 60 combine to establish an ornamental surface design of a top rail 67. Likewise, a second horizontal mark 64 extending between the vertical marks 61, 62 proximate to the lower edge of the door skin 60 combines with the horizontal wood grain pattern to simulate the appearance of a bottom rail 68. The central area 69 bordered by the simulated stiles 65, 66 and simulated rails 67, 68 has the appearance of an interior panel member.

Figure 11:
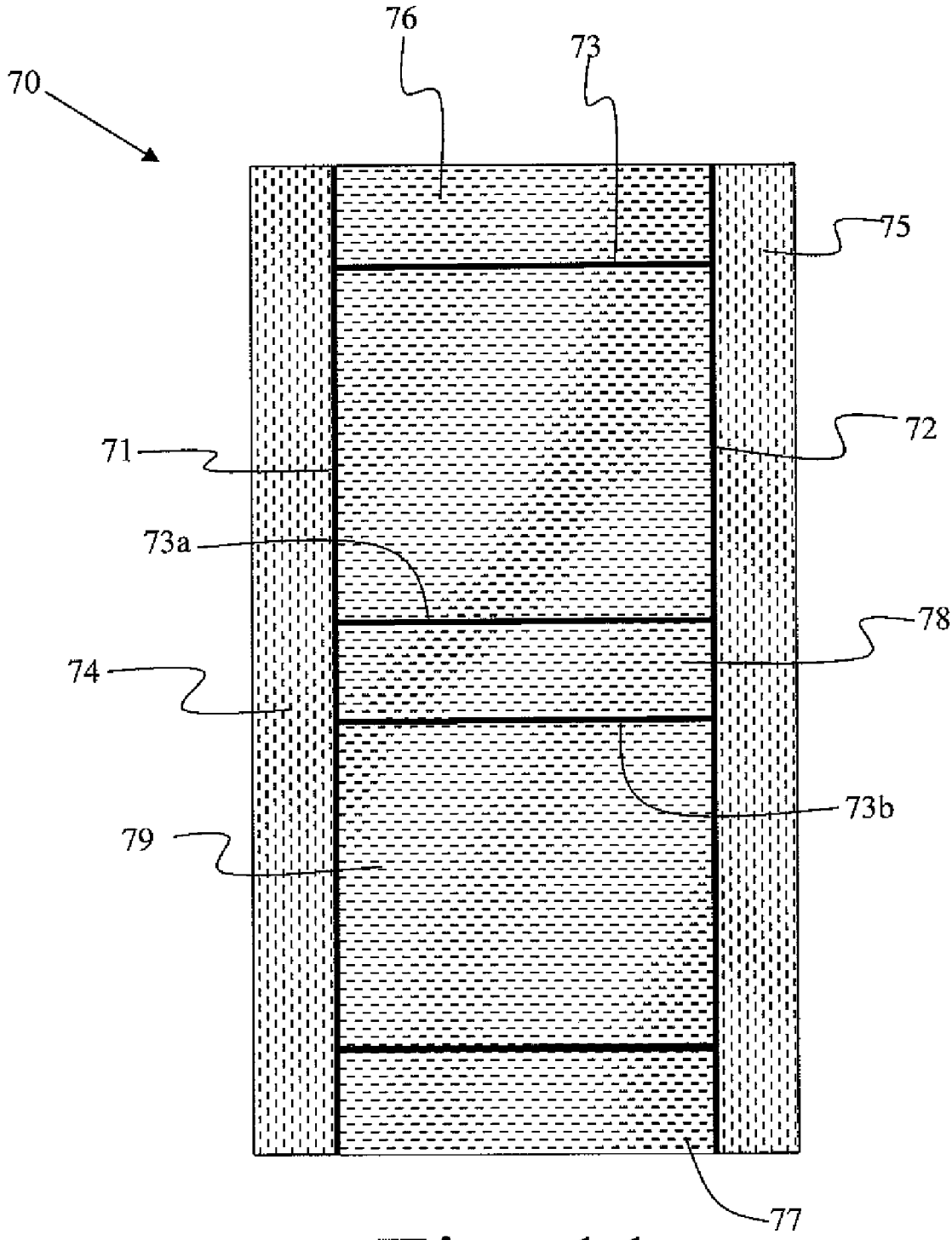
FIG. 11 is an elevational view depicting a flush door skin having its exterior surface demarcated into a plurality of ornamental features to establish an ornamental surface design different than that of FIG. 10.

Turning to FIG. 11, there is shown a flush door skin 70 cut from the universal master board 20 in such a manner as to establish on its exterior surface an assortment of simulated wood grain patterns that is similar to that of flush door skin 36 of FIG. 4. The flush door skin 70 includes vertical marks 71 and 72 similar to marks 61 and 62 discussed above to create the visual impression of first and second stiles 74 and 75, respectively. The flush door skin 70 also includes an uppermost and a lowermost horizontal mark 73 similar to marks 63 and 64 to create ornamental designs simulating upper and lower rails 76, 77. Additional horizontal marks 73*a*, 73*b* are provided near the center of the door to establish an intermediate rail 78. The simulated stiles 74, 75 and rails 76, 77, 78 border upper and lower interior panel members 79. The wood grain patterns of the stiles 74, 75 run substantially perpendicular to the wood grain patterns of the rails 76, 77.

Figure 12:
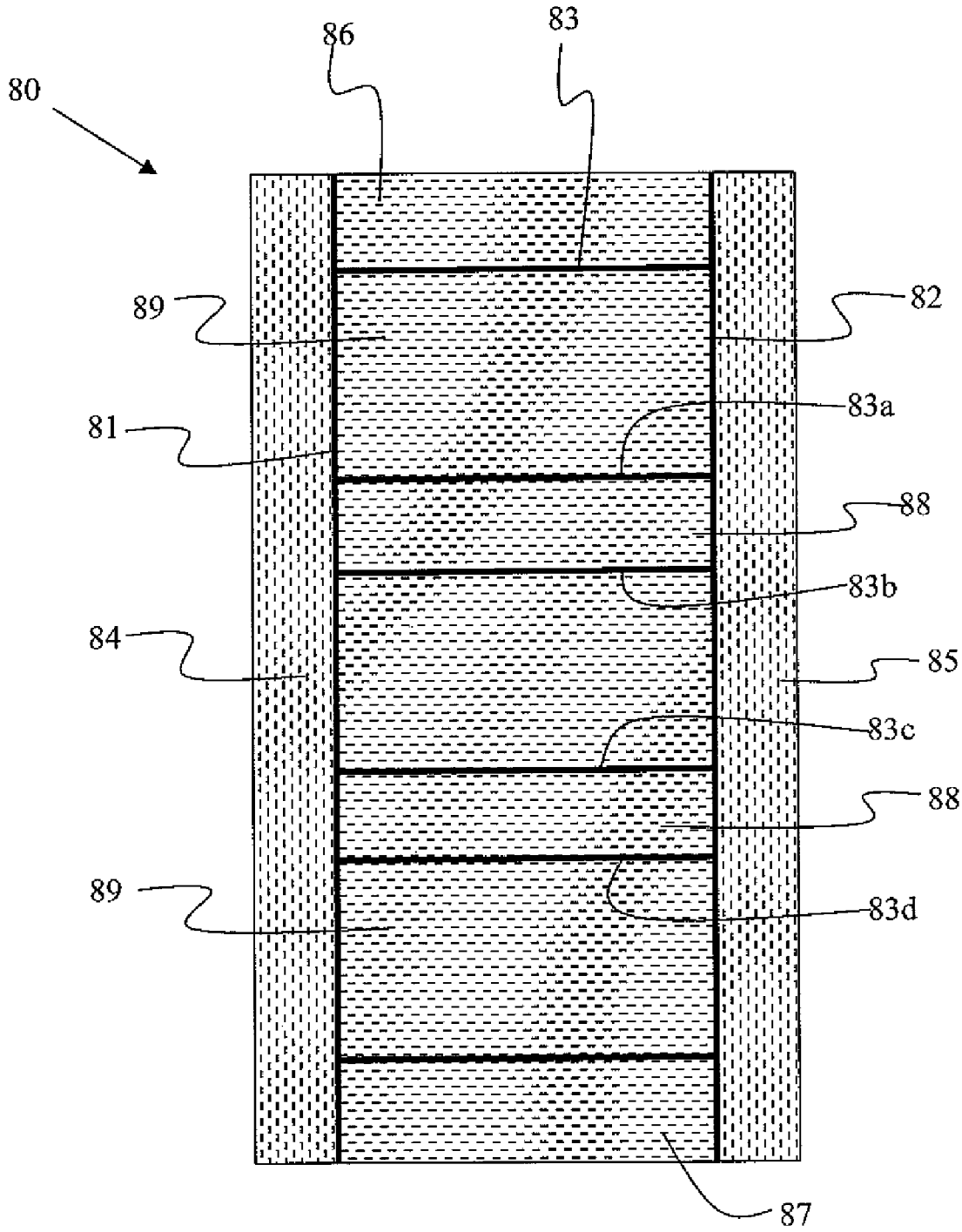
FIG. 12 is an elevational view depicting a flush door skin having its exterior surface demarcated into a plurality of ornamental features to establish another ornamental surface design different than that of FIGS. 10 and 11.

FIG. 12 shows another flush door skin 80 cut from the universal master board 20 in such a manner as to establish an assortment of simulated wood grain patterns that is similar to that of flush door skin 36 of FIG. 4. The flush door skin 80 has vertical marks 81 and 82 similar to marks 61 and 62 discussed above to create the visual impression of first and second stiles 84 and 85, respectively. The flush door skin 80 also includes an uppermost and a lowermost horizontal mark 83 similar to marks 63 and 64 to create ornamental designs simulating upper and lower rails 86, 87. Additional sets of horizontal marks 83*a*, 83*b*, 83*c*, and 83*d* partition the center region of the door skin 80 into upper and lower intermediate rails 88, and three interior panel members 89, which are each bordered by the simulated stiles 84, 85 and simulated rails 86, 87, and 88.

Figure 13:
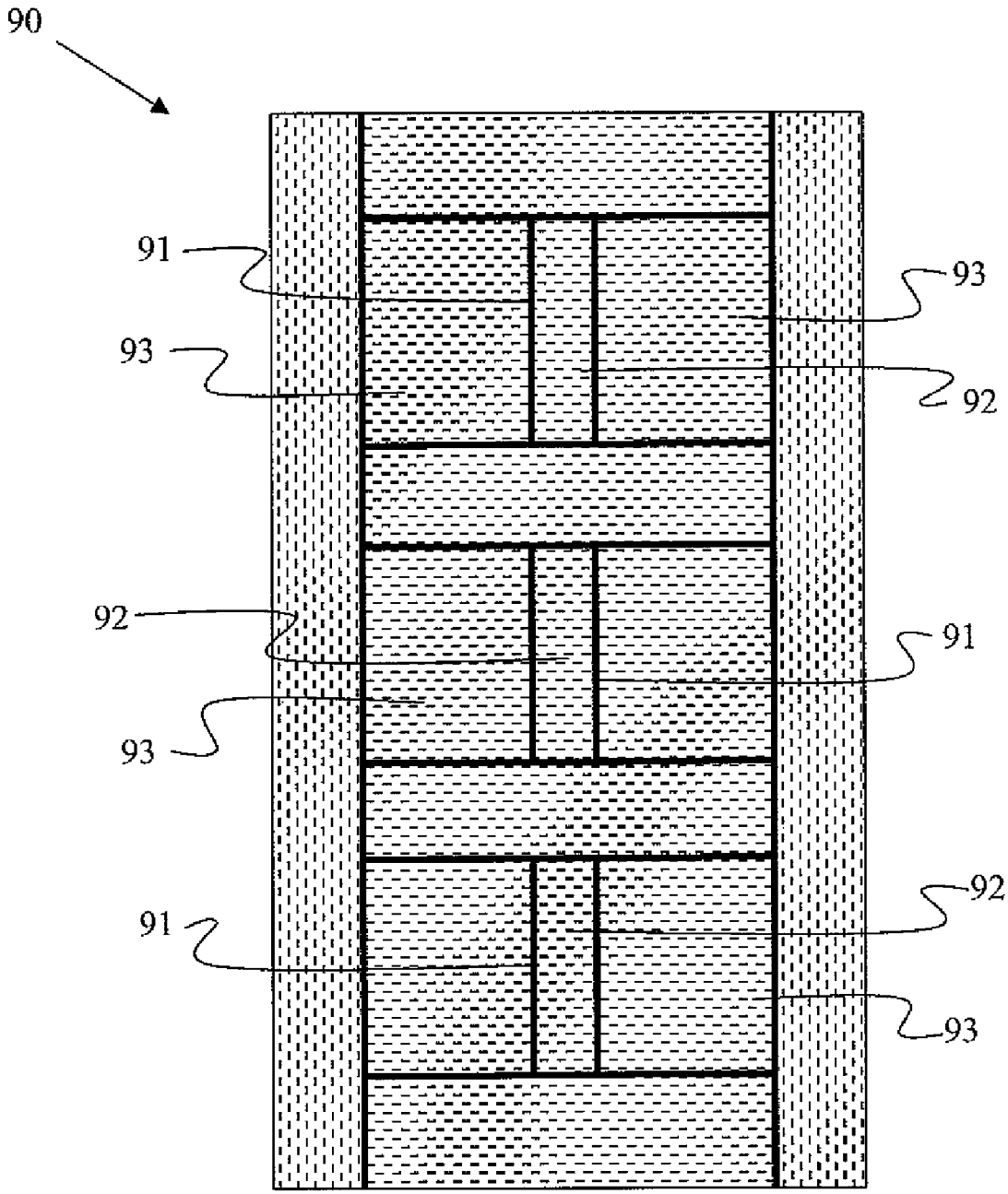
FIG. 13 is an elevational view depicting a modification to the flush door skin of FIG. 12.

FIG. 13 shows another flush door skin 90 cut from the universal master board 20 in such a manner as to establish an assortment of simulated wood grain patterns that is similar to that of flush door skin 36 of FIG. 4. The flush door skin 90 of FIG. 13 is virtually identical to the flush door skin 80 of FIG. 12, except that flush door skin 90 contains additional interior vertical marks 91 to provide the appearance of interior stiles 92, thereby providing the exterior surface of the door skin 90 with the appearance of six simulated interior panel members 93.

While the embodiments of FIGS. 10-13 discussed above involve the cutting of the respective door skins from universal master boards prior to surface marking, it is within the scope of the invention to perform surface marking on the universal master boards before the door skins are cut from the boards.

The above detailed description of exemplary embodiments and drawing FIGS. 10-13 demonstrate a particularly advantageous feature of certain exemplary embodiments of the invention. The door skins 60, 70, 80, and 90 having substantially identical assortments of simulated wood grain patterns, and each made from substantially identical universal master boards 20, can serve as a source or foundation for deriving multiple different ornamental surface designs of stile, rail, and/or internal panel combinations. As a consequence, separate mold die embossing plates are not required to produce substantially different ornamental surface designs, such as shown in FIGS. 10-13.

While other ornamental features can be provided, the combination of simulated door panels and wood grain is quite popular and has been used in connection with the above description of many of the exemplary embodiments.

Figure 14:
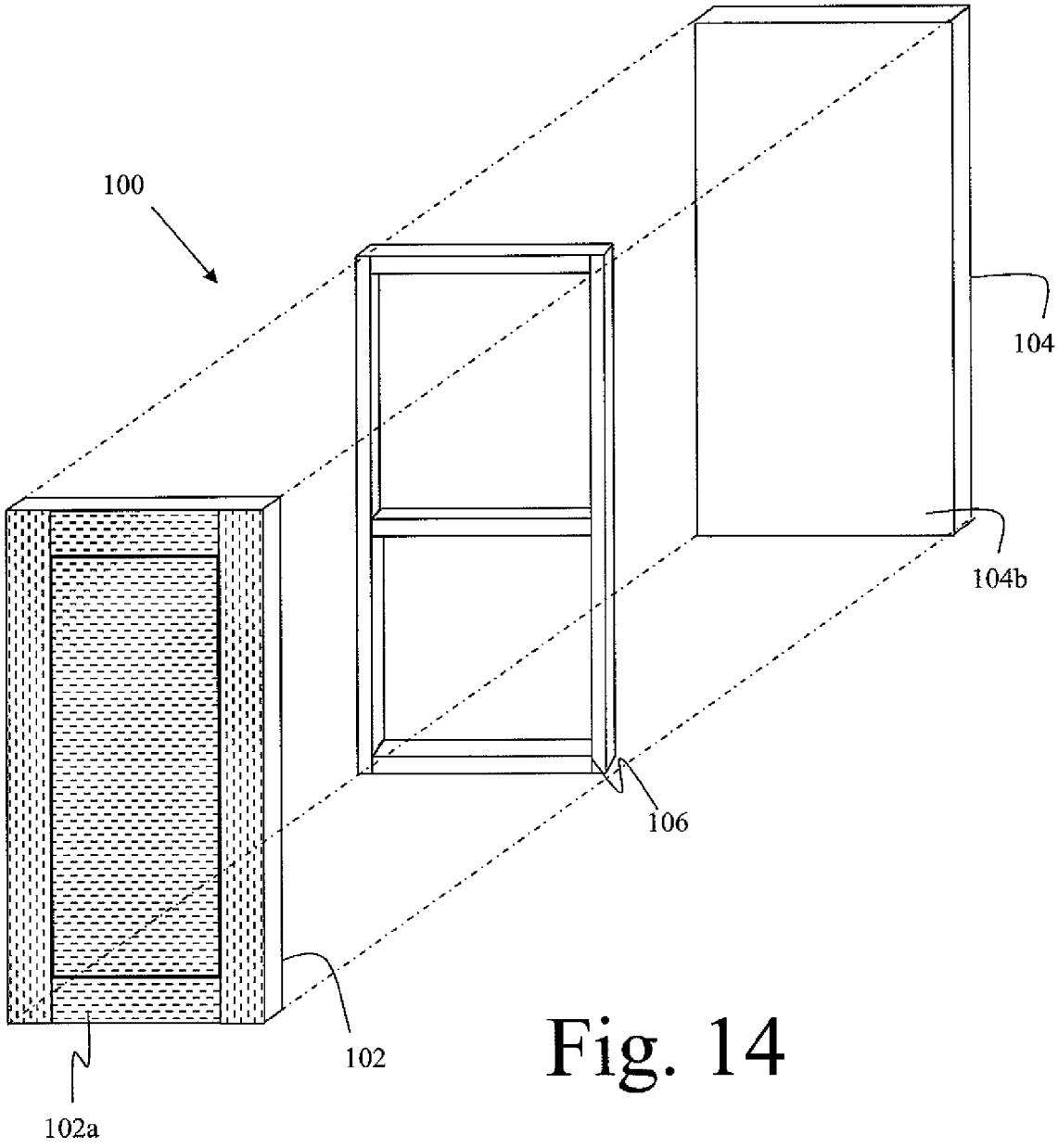
FIG. 14 is an assembly view of a door containing one or more door skins made according to embodiments of the invention.

A so-called hollow core door 100 according to an embodiment of the invention is shown in FIG. 14. The hollow core door 100 includes first and second skins 102, 104, one or both of which is/are prepared according to embodiments of the invention described above. Door skins 102, 104 made of MDF and the like typically have thicknesses on the order of, for example, about 0.125 to about 0.75 inch. Door skins 102, 104 made of sheet molding compounds and the like typically have a thickness on the order of about 0.065 inch to about 0.1875 inch. The door skins 102, 104 include respective exterior surfaces facing away from one another and respective interior surfaces facing one another. The exterior surface 102*a* (shown with respect to skin 102 only) possesses an ornamental surface design. The exterior surface 102*a* may possess the same design or a different design than the exterior surface (not shown) of door skin 104.

The interior surface (not shown) of the first door skin 102 and the interior surface 104*b* of the second door skin 104 are secured to opposite sides of a frame 106 using adhesive, fasteners, or other securing methods, devices, methods, etc. The interior surfaces of skins 102, 104 are spaced from one another to define a hollow core that is surrounded by the frame 106. Because the interior surfaces of the door skins 102, 104 are concealed from view, it is not common practice to decorate the interior surfaces, although the interior surfaces may possess a roughened texture to promote bonding to the frame 106. The frame 106 may be made out of wood or other materials, as known in the art. As also known in the art, hollow core door 100 may also include additional support members and/or a core such as foam disposed in the hollow area between the flush door skins 102, 104. For example, the frame 106 may include interior vertical framing members and additional interior horizontal framing members depending upon how and where the panel segments are cut and reassembled.

Articles that may be prepared according to embodiments of the invention include synthetic building components intended to replicate natural wood. Especially contemplated are exterior entry doors and interior passage doors. Other building components that may be subject to the exemplary methods and systems described herein include furniture and cabinet doors, closet and bifold doors, door trim, window frames, furniture elements, cabinetry, picture frames, tables, molded wall paneling, wainscot, siding, decking, wall panels, siding, railings, window trim, architectural trim, flooring, etc. For explanatory purposes, exemplary embodiments below are described in relation to door structures. It should be understood that the methods described herein may be used for marking other building component and articles other than building components.

The foregoing detailed description of the certain exemplary embodiments of the invention has been provided for the purpose of explaining the principles of the invention and its practical application, thereby enabling others skilled in the art to understand the invention for various embodiments and with various modifications as are suited to the particular use contemplated. This description is not intended to be exhaustive or to limit the invention to the precise embodiments disclosed. Although only a few embodiments have been disclosed in detail above, other embodiments are possible and the inventors intend these to be encompassed within this specification and the scope of the appended claims. The specification describes specific examples to accomplish a more general goal that may be accomplished in another way. Modifications and equivalents will be apparent to practitioners skilled in this art and are encompassed within the spirit and scope of the appended claims and their appropriate equivalents. This disclosure is intended to be exemplary, and the claims are intended to cover any modification or alternative which might be predictable to a person having ordinary skill in the art.

Only those claims which use the words "means for" are to be interpreted under 35 USC 112, sixth paragraph. Moreover, no limitations from the specification are to be read into any claims, unless those limitations are expressly included in the claims.

What is claimed is:

1. A method of converting universal master boards into flush door skins having different assortments of simulated wood grain patterns, the method comprising:

providing a plurality of universal master boards each having an expansive surface, each said expansive surface having a graphic design of at least first depressions and second depressions in at least first and second surface regions, respectively, the first depressions being substantially parallel to one another and substantially aligned in a first direction to simulate a first textured wood grain pattern in the first surface region, the second depressions being substantially parallel to one another and substantially aligned in a second direction that is different than the first direction to simulate a second textured wood grain pattern in the second surface region, the plurality of universal master boards including at least first and second universal master boards;

cutting the first universal master board at a first location to form a first flush door skin having a first exterior surface with a first assortment of simulated wood grains comprising at least one pattern selected from the group consisting of the simulated first wood grain pattern and the simulated second wood grain pattern; and cutting the second universal master board at a second location which does not correspond to the first location to form a second flush door skin having a second exterior surface with a second assortment of simulated wood grains comprising at least one pattern selected from the group consisting of the simulated first wood grain pattern and the simulated second wood grain pattern, the second assortment of simulated wood grains differing from the first assortment of simulated wood grains.

2. The method according to claim 1, wherein the first assortment of simulated wood grains on the first exterior surface shares common graphic design features with the second assortment of simulated wood grains on the second exterior surface.

3. The method according to claim 1, further comprising embossing the first and second depressions in the first and second universal master boards.

4. The method according to claim 1, wherein the simulated first grain wood pattern comprises at least one simulated vertical wood grain pattern, and wherein the simulated second wood grain pattern comprises at least one simulated horizontal wood grain pattern.

5. The method according to claim 1, wherein the universal master boards comprise a member selected from the group consisting of medium density fiberboard and high density fiberboard.

6. The method according to claim 1, wherein the universal master boards comprise a member selected from the group consisting of a sheet molding compound and a sheet molding compound-fiberglass composite.

7. The method according to claim 1, wherein the universal master boards comprise steel.

8. A method of converting universal master boards into flush door skins having different assortments of simulated wood grain patterns, the method comprising:

providing a plurality of universal master boards each having an expansive surface, each said expansive surface having a graphic design of at least first depressions and second depressions in at least first and second surface regions, respectively, the first depressions being substantially parallel to one another and substantially aligned in a first direction to simulate a first wood grain pattern in the first surface region, the second depressions being substantially parallel to one another and substantially aligned in a second direction that is different than the first direction to simulate a second wood grain pattern in the second surface region, the plurality of universal master boards including at least first and second universal master boards;

selecting a first assortment of simulated wood grains from the first universal master board, the first assortment of simulated wood grains comprising at least one pattern selected from the group consisting of the simulated first wood grain pattern and the simulated second wood grain pattern;

cutting the first universal master board to form a first flush door skin having a first exterior surface with the first assortment of simulated wood grains;

demarcating the first assortment of simulated wood grains into a plurality of sections representing first ornamental features to establish a first ornamental surface design for the first flush door skin;

selecting a second assortment of simulated wood grains from the second universal master board, the second assortment of simulated wood grains comprising at least one pattern selected from the group consisting of the simulated first wood grain pattern and the simulated second wood grain pattern, the second assortment of simulated wood grains differing from the first assortment of simulated wood grains;

cutting the second universal master board to form a second flush door skin having a second exterior surface with the second assortment of simulated wood grains; and demarcating the second assortment of simulated wood grains into a plurality of sections representing second ornamental features to establish a second ornamental surface design for the second flush door skin.

9. The method according to claim 8, wherein the first assortment of simulated wood grains on the first exterior surface shares common graphic design features with the second assortment of simulated wood grains on the second exterior surface.

10. The method according to claim 8, wherein said demarcating of the first assortment of simulated wood grains comprises machining a groove to establish the ornamental feature in at least one of the expansive surface of the first universal master board and the first exterior surface.

11. The method according to claim 8, wherein said demarcating of the first assortment of simulated wood grains comprises lasing a groove to establish the ornamental feature in at least one of the expansive surface of the first universal master board and the first exterior surface.

12. The method according to claim 8, wherein said demarcating of the first assortment of simulated wood grains comprises printing a line to establish the ornamental feature on at least one of the expansive surface of the first universal master board and the first exterior surface.

13. The method according to claim 8, wherein:

the first assortment of simulated wood grains comprising both the first depressions and the second depressions; and said demarcating comprises demarcating the first assortment of simulated wood grains at an interfacing boundary between the first and second depressions.

14. The method according to claim 8, wherein the first wood grain pattern and the second wood grain pattern of the first universal master board comprises at least one vertical wood grain pattern and at least one horizontal wood grain pattern, respectively.

15. The method according to claim 14, wherein:

the first assortment of simulated wood grains comprises both the first depressions simulating the vertical wood grain pattern and the second depressions simulating the horizontal wood grain pattern; and said demarcating comprises demarcating the first assortment of simulated wood grains at an interfacing boundary between the vertical wood grain pattern and the horizontal wood grain pattern to simulate at least one stile having the vertical wood grain pattern and at least one rail having the horizontal wood grain pattern.

16. The method according to claim 8, wherein the universal master boards comprise a member selected from the group consisting of medium density fiberboard and high density fiberboard.

17. A method of converting universal master boards into flush door skins having different assortments of simulated wood grain patterns, the method comprising:

providing a plurality of flush universal master boards each having an expansive surface, each said expansive surface having a graphic design of depressions being substantially parallel to one another and substantially aligned in a direction to simulate a textured wood grain pattern, the plurality of flush universal master boards including a first flush universal master board and a second flush universal master board;

demarcating the expansive surface of the first flush universal master board into a plurality of sections representing first ornamental features to establish a first ornamental surface design; and demarcating the expansive surface of the second flush universal master board into a plurality of sections representing second ornamental features to establish a second ornamental surface design, the second ornamental surface design differing from the first ornamental surface design.

18. The method according to claim 17, wherein said demarcating the expansive surface-of the first flush universal master board comprises machining a groove to establish the first ornamental surface design.

19. The method according to claim 17, wherein said demarcating of the expansive surface of the first flush universal master board comprises lasing a groove to establish the first ornamental surface design.

20. The method according to claim 17, wherein said demarcating of the expansive surface of the first flush universal master board comprises printing a mark to establish the first ornamental surface design.

21. The method according to claim 17, wherein:

the expansive surface of the first flush universal master board contains first depressions and second depressions simulating first and second wood grain patterns extending in different directions relative to one another; and said demarcating of the expansive surface of the first flush universal master board comprises demarcating the expansive surface at an interfacing boundary between the first and second wood grain patterns.

22. The method according to claim 21, wherein the first wood grain pattern and the second wood grain pattern comprises at least one vertical wood grain pattern and at least one horizontal wood grain pattern, respectively.

23. A method according to claim 22, wherein:

said demarcating of the expansive surface of the first flush universal master board comprises demarcating at an interfacing boundary between the vertical wood grain pattern and the horizontal wood grain pattern to simulate at least one stile having the vertical wood grain pattern and at least one rail having the horizontal wood grain pattern on the expansive surface.

24. The method according to claim 17, wherein the flush universal master boards comprise a member selected from the group consisting of medium density fiberboard and high density fiberboard.

25. The method according to claim 17, further comprising cutting the first and second flush universal master boards to form first and second flush door skins, respectively, said cutting preceding said demarcating of the expansive surfaces.

26. A method of converting universal master boards into flush door skins, the method comprising:

providing a universal master board having a surface with a graphic design comprising at least first depressions and second depressions in the surface at first and second surface regions, respectively, the first depressions being substantially parallel to one another and substantially aligned in a first direction to simulate a first textured wood grain pattern in the first surface region, the second depressions being substantially parallel to one another and substantially aligned in a second direction that is different than the first direction to simulate a second textured wood grain pattern in the second surface region, the surface of the universal master board being sufficiently expansive to permit selective positioning of a hypothetical cutting template having a boundary commensurate with a perimeter of a flush door skin at any one of multiple positions on the surface of the universal master board, wherein at each of the multiple positions the boundary of the hypothetical cutting template captures a respective one of multiple possible assortments of simulated wood grains comprising at least one pattern selected from the group consisting of the simulated first wood grain pattern and the simulated second wood grain pattern; and cutting the expansive surface of the universal master board along the hypothetical cutting template at the selective position to provide the flush door skin having the selected assortment of simulated wood grains.

27. A method of making a door from universal master boards, the method comprising:

providing a plurality of universal master boards each having an expansive surface, each said expansive surface having a graphic design of at least first depressions and second depressions in at least first and second surface regions, respectively, the first depressions being substantially parallel to one another and substantially aligned in a first direction to simulate a first textured wood grain pattern in the first surface region, the second depressions being substantially parallel to one another and substantially aligned in a second direction that is different than the first direction to simulate a second textured wood grain pattern in the second surface region, the plurality of universal master boards including at least first and second universal master boards;

cutting the first universal master board at a first location to form a first flush door skin having a first exterior surface with a first assortment of simulated wood grains comprising at least one pattern selected from the group consisting of the simulated first wood grain pattern and the simulated second wood grain pattern;

cutting the second universal master board at a second location which does not correspond to the first location to form a second flush door skin having a second exterior surface with a second assortment of simulated wood grains comprising at least one pattern selected from the group consisting of the simulated first wood grain pattern and the simulated second wood grain pattern, the second assortment of simulated wood grains differing from the first assortment of simulated wood grains; and securing the first flush door skin to a first side of a door frame.

* * * * *